US009103250B2

(12) United States Patent
Iwasaki

(10) Patent No.: US 9,103,250 B2
(45) Date of Patent: Aug. 11, 2015

(54) EXHAUST GAS HEAT EXCHANGER

(71) Applicant: Calsonic Kansei Corporation, Saitama-shi, Saitama (JP)

(72) Inventor: Mitsuru Iwasaki, Saitama (JP)

(73) Assignee: CALSONIC KANSEI CORPORATION, Saitama-shi (JP)

( * ) Notice: Subject to any disclaimer, the term of this patent is extended or adjusted under 35 U.S.C. 154(b) by 0 days.

(21) Appl. No.: 14/352,177

(22) PCT Filed: Oct. 17, 2012

(86) PCT No.: PCT/JP2012/076791

§ 371 (c)(1),
(2) Date: Apr. 16, 2014

(87) PCT Pub. No.: WO2013/058267

PCT Pub. Date: Apr. 25, 2013

(65) Prior Publication Data

US 2014/0238006 A1 Aug. 28, 2014

(30) Foreign Application Priority Data

Oct. 18, 2011 (JP) ..... 2011-228910
Oct. 12, 2012 (JP) ..... 2012-226728

(51) Int. Cl.
*F01N 3/02* (2006.01)
*F02M 25/07* (2006.01)
(Continued)

(52) U.S. Cl.
CPC ..... *F01N 3/0205* (2013.01); *F01N 1/083* (2013.01); *F02B 29/0462* (2013.01); *F02M 25/0731* (2013.01); *F02M 25/0737* (2013.01); *F28F 3/027* (2013.01); *F01N 1/086* (2013.01);
(Continued)

(58) Field of Classification Search
CPC ..... F01N 1/083; F01N 1/086; F01N 3/0205; F01N 3/043; F01N 2240/02; F01N 2240/20; F01N 2260/024; F01N 2470/12; F02B 29/0462; F02M 25/0731; F02M 25/0737
USPC ..... 60/278, 298, 320, 324
See application file for complete search history.

(56) References Cited

U.S. PATENT DOCUMENTS 7,055,586 B2 6/2006 Sakakibara et al.
2002/0074105 A1* 6/2002 Hayashi et al. ..... 165/43
(Continued)

FOREIGN PATENT DOCUMENTS

EP 1 391 675 A1 2/2004
EP 1 411 315 A1 4/2004
(Continued)

*Primary Examiner* — Thomas Denion
*Assistant Examiner* — Jorge Leon, Jr.
(74) *Attorney, Agent, or Firm* — Foley & Lardner LLP

(57) ABSTRACT

An exhaust gas heat exchanger includes a tube through which exhaust gas flows, a fin disposed in the tube, and protruded tabs protruded from the tube or the fin. Each of the protruded tabs is inclined to an upstream side, and has a polygonal shape more than a quadrilateral shape having at least a bottom side, one lateral side and another lateral side. An angle of the one lateral side to the bottom side is set smaller than 90 degrees and than an angle of the other lateral side to the bottom side. The bottom side is placed to intersect with a perpendicular direction to the exhaust gas flow direction, and the other lateral side is located upstream from the one lateral side. According to the exhaust gas heat exchanger, it is possible to improve heat exchange efficiency by generating a swirl flow for facilitating heat transfer effectively.

15 Claims, 21 Drawing Sheets

(51) Int. Cl.

| | |
|---|---|
| ***F01N 1/08*** | (2006.01) |
| ***F02B 29/04*** | (2006.01) |
| ***F28F 3/02*** | (2006.01) |
| *F01N 3/04* | (2006.01) |
| *F28D 21/00* | (2006.01) |

(52) U.S. Cl.
CPC ..... *F01N3/043* (2013.01); *F01N 2240/02* (2013.01); *F01N 2240/20* (2013.01); *F01N 2260/024* (2013.01); *F01N 2470/12* (2013.01); *F28D 21/0003* (2013.01)

(56) References Cited

U.S. PATENT DOCUMENTS

| | | | | |
|---|---|---|---|---|
| 2004/0134640 | A1 | 7/2004 | Sakakibara et al. | |
| 2005/0109493 | A1* | 5/2005 | Wu et al. | 165/157 |
| 2006/0016582 | A1* | 1/2006 | Hashimoto et al. | 165/109.1 |
| 2006/0048921 | A1 | 3/2006 | Usui et al. | |
| 2006/0130818 | A1* | 6/2006 | Igami et al. | 123/568.12 |
| 2008/0011464 | A1* | 1/2008 | Oofune et al. | 165/157 |
| 2008/0164014 | A1* | 7/2008 | Nakamura | 165/165 |
| 2009/0025916 | A1* | 1/2009 | Meshenky et al. | 165/151 |
| 2010/0095659 | A1* | 4/2010 | Kuroyanagi et al. | 60/320 |
| 2010/0162699 | A1* | 7/2010 | Dittmann et al. | 60/605.2 |
| 2011/0185714 | A1* | 8/2011 | Lohbreyer et al. | 60/320 |

FOREIGN PATENT DOCUMENTS

| | | | |
|---|---|---|---|
| EP | 1 898 464 | A1 | 3/2008 |
| JP | 2002-350081 | A | 12/2002 |
| JP | 2003-227691 | A | 8/2003 |
| JP | 2003-279293 | A | 10/2003 |
| JP | 2010-096456 | A | 4/2010 |

* cited by examiner (a)

(b)

(a)

(b)

(c)

(a)

(b)

(a)

(b)

(a)

(b)

-PRIOR ART-

-PRIOR ART-

-PRIOR ART-

-PRIOR ART-

-PRIOR ART-

EXHAUST GAS HEAT EXCHANGER

TECHNICAL FIELD

The present invention relates to an exhaust gas heat exchanger for exchanging heat between exhaust gas and cooling fluid of an internal combustion engine.

BACKGROUND ART

A Patent Document 1 listed below discloses an exhaust gas heat exchanger for exchanging heat between exhaust gas and cooling fluid of an internal combustion engine. As shown in FIG. 20, the exhaust gas heat exchanger 100 disclosed in the Patent Document 1 includes an outer case 101, plural tubes 110 accommodated in the outer case 101, and a pair of tanks 120 and 121 disposed at both ends of the plural tubes 110.

The outer case 101 is provided with a coolant inlet port 102 and a coolant outlet port 103 for coolant (cooling fluid). Coolant flow path 104 is formed inside the outer case 101 and outside the tubes 110. The both ends of the tubes 110 are opened to insides of the tanks 120 and 121, respectively. An exhaust gas inlet port 120*a* is formed at the tank 120 on one side, and an exhaust gas outlet port 121*a* is formed at the tank 121 on another side.

The tubes 110 are stacked. As shown in FIG. 21, each of the tubes 110 is formed by two flat members 110*a* and 110*b*. An exhaust gas flow path 111 is formed within each of the tubes 110. A fin 112 is disposed in the exhaust gas flow path 111.

As shown in FIG. 22, the fin 112 is made by a corrugated panel having a rectangular outline shape. On each horizontal wall of the fin 112, plural protruded tabs 113 are cut and raised at intervals along an exhaust gas flow direction S. Each of the protruded tabs 113 has a triangle shape, and is protruded so as to inhibit an exhaust gas flow in the exhaust gas flow path 111. Namely, the protruded tabs 113 are protruded in a perpendicular direction to the exhaust gas flow direction S, and inclined against the exhaust gas flow direction S.

The exhaust gas from the internal combustion engine flows through the exhaust gas flow path 111 in each of the tubes 110. The coolant flows through the coolant flow path 104 in the outer case 101. The exhaust gas and the coolant exchange heat via the tubes 110 and the fin 112. At this heat exchange, the exhaust gas flow is agitated by the protruded tabs 113 of the fin 112, and thereby the heat exchange is facilitated.

As shown in FIG. 23, since the exhaust gas cannot flow straight due to the protruded tab(s) 113, a low pressure area is generated just downstream of the protruded tab 113. As shown in FIGS. 24(*a*) and (*b*), the exhaust gas that hits the protruded tab 113 flows over inclined sides 113*a* and 113*b*, and then flows around behind the protruded tab 113. Since the protruded tab 113 has a triangle shape, in a first flow flowing over the inclined side 113*a* and a second flow flowing over the inclined side 113*b*, flow amounts at upper portions of inclinations of the inclined sides 113*a* and 113*b* become large and flow amounts at lower portions of the inclinations become small, respectively, due to the inclinations of the inclined sides 113*a* and 113*b*.

These flows having the above flow amount distribution are drawn into the above-explained low pressure area, and thereby rotating forces act on the first flow and the second flow. As a result, as shown in FIGS. 24(*a*) and (*b*), the first flow and the second flow become swirl flows, respectively. In this manner, the two swirl flows are generated downstream of the protruded tab 113. Since these swirl flows break laminar flows near inner surfaces of the exhaust gas flow path 111 and thereby agitate the exhaust gas flow, heat exchange efficiency is improved.

PRIOR ART DOCUMENT

Patent Documents

Patent Document 1: Japanese Patent Application Laid-Open No. 2010-96456

SUMMARY OF INVENTION

However, in the above-explained exhaust gas heat exchanger 100, since the protruded tab(s) 113 has a triangle shape, an area for blocking the exhaust gas flow is small and thereby pressure of the low pressure area is not made sufficiently low. Therefore, a force drawing the first flow and the second flow is small, so that only weak swirl flows are generated. Even in a case where one of the first flow and the second flow is larger than another and thereby only one swirl flow is generated, only a weak swirl is generated because the drawing force is small. Since a weak swirl flow(s) cannot agitate the exhaust gas flow sufficiently, heat transfer cannot be facilitated effectively.

An object of the present invention is to provide an exhaust gas heat exchanger that can improve heat exchange efficiency by generating a swirl flow that can facilitate heat transfer effectively.

An aspect of the present invention provides an exhaust gas heat exchanger for exchanging heat between exhaust gas and cooling fluid of an internal combustion engine, comprising: a tube forming an exhaust gas flow path through which the exhaust gas flows; a fin disposed in the exhaust gas flow path; and a plurality of protruded tabs protruded from at least one of the tube and the fin to inhibit an exhaust gas flow, wherein each of the plurality of protruded tabs has a polygonal shape more than a quadrilateral shape having at least a bottom side, one lateral side and another lateral side, and an angle of the one lateral side to the bottom side is set smaller than an angle of the other lateral side to the bottom side and set smaller than 90 degrees, each of the plurality of protruded tabs is inclined to an upstream side along an exhaust gas flow direction, and, in each of the plurality of protruded tabs, the bottom side is placed to intersect with a perpendicular direction to the exhaust gas flow direction, and the other lateral side is located upstream from the one lateral side.

According to the aspect, it is possible to generate a large strong swirl flow by the protruded tabs. The swirl flow breaks laminar flows near inner surfaces of the exhaust gas flow path and agitates the exhaust gas flow, so that heat transfer is facilitated effectively and heat exchange efficiency is improved.

It is preferable that each of the plurality of protruded tabs has a trapezoidal shape in which the angle of the other lateral side to the bottom side is set to 90 degree and the angle of the one lateral side to the bottom side is set to 60 degrees.

It is preferable that an inclined angle to an upstream side of each of the plurality of protruded tabs is set in a range not smaller than 40 degrees and not larger than 90 degrees (especially, set to 60 degrees).

It is preferable that a placement angle of each of the plurality of protruded tabs that is an intersecting angle of the bottom side with the perpendicular direction is set in a range not smaller than 10 degrees and not larger than 50 degrees (especially set to 30 degrees).

It is preferable that each of the plurality of protruded tabs has a trapezoidal shape, and, when a length of the bottom side of each of the plurality of protruded tabs viewed in the exhaust gas flow direction is denoted as H and a height thereof is denoted as h, h/H is set in a range not smaller than 0.2 and not larger than 0.7.

It is preferable that the exhaust gas flow path is segmented into a plurality of segmented flow channels aligned along the perpendicular direction to the exhaust gas flow direction, and, the plurality of protruded tabs is disposed at intervals along the exhaust gas flow direction in each of the plurality of segmented flow channels.

Here, it is preferable that every two of the plurality of protruded tabs adjacent side by side are aligned at intervals along the exhaust gas flow direction, and the two protruded tabs adjacent side by side have line-symmetrical shapes to each other with respect to the exhaust gas flow direction.

Alternatively, it is preferable that the plurality of protruded tabs is aligned alternately on both sides of a center of a segmented flow channel along the exhaust gas flow direction in the plurality of segmented flow channels.

Here, it is preferable that the plurality of protruded tabs is overlapped at the center of the segmented flow channel along the exhaust gas flow direction.

In addition, it is preferable that the plurality of protruded tabs is formed on at least two inner surfaces of each of the plurality of segmented flow channels, and it is further preferable that the two inner surfaces face to each other. Further, it is preferable that the two inner surfaces are included in the fin, and back surfaces of the two surfaces are planarly contacted with inner surfaces of the tube.

In addition, it is preferable that the protruded tabs formed on one of the two inner surfaces and the protruded tabs formed on another of the two inner surfaces are disposed alternately along the exhaust gas flow direction in each of the segmented flow channels.

DESCRIPTION OF EMBODIMENTS

Hereinafter, embodiments according to the present invention will be explained with reference to the drawings.

First Embodiment

Figure 1:
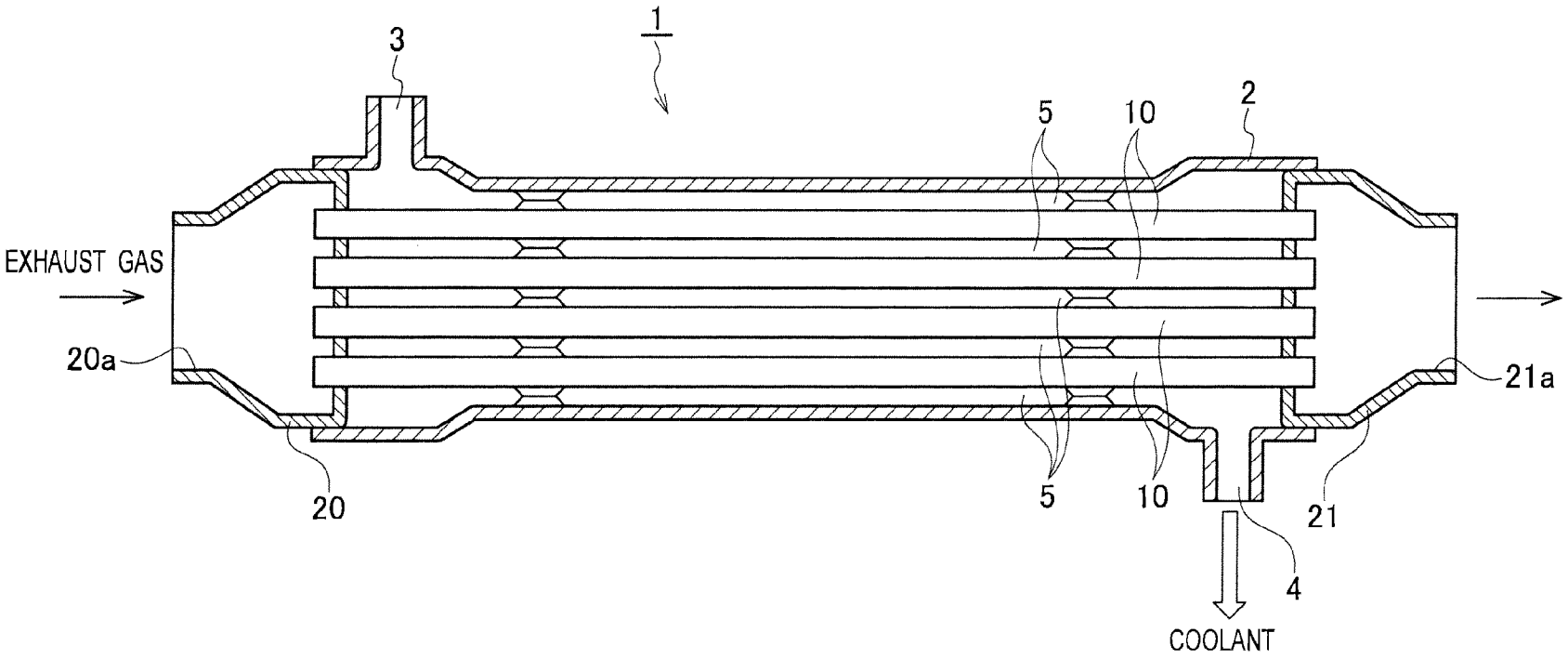
FIG. 1 It is a cross-sectional view of an exhaust gas heat exchanger (EGR cooler) according to a first embodiment.

An exhaust gas heat exchanger according to a first embodiment will be explained with reference to FIG. 1 to FIG. 10. The exhaust gas heat exchanger in the present embodiment is an EGR cooler 1 for cooling recirculated exhaust gas in an EGR (exhaust gas recirculation) device for recirculating exhaust gas into intake gas in an internal combustion engine. As shown in FIG. 1, the EGR cooler 1 includes an outer case 2, plural tubes 10 accommodated in the outer case 2, and a pair of tanks 20 and 21 disposed at both ends of the plural tubes 10. These components are made of material having superior heat and corrosion resistance properties (i.e. stainless steel). These members are fixed with each other by brazing.

The outer case 2 is provided with a coolant inlet port 3 and a coolant outlet port 4 for coolant (cooling fluid). Coolant flow path 5 is formed inside the outer case 2 and outside the tubes 10. The both ends of the tubes 10 are opened to insides of the tanks 20 and 21, respectively. An exhaust gas inlet port 20*a* is formed at the tank 20 on one side, and an exhaust gas outlet port 21*a* is formed at the tank 21 on another side.

Figure 2:
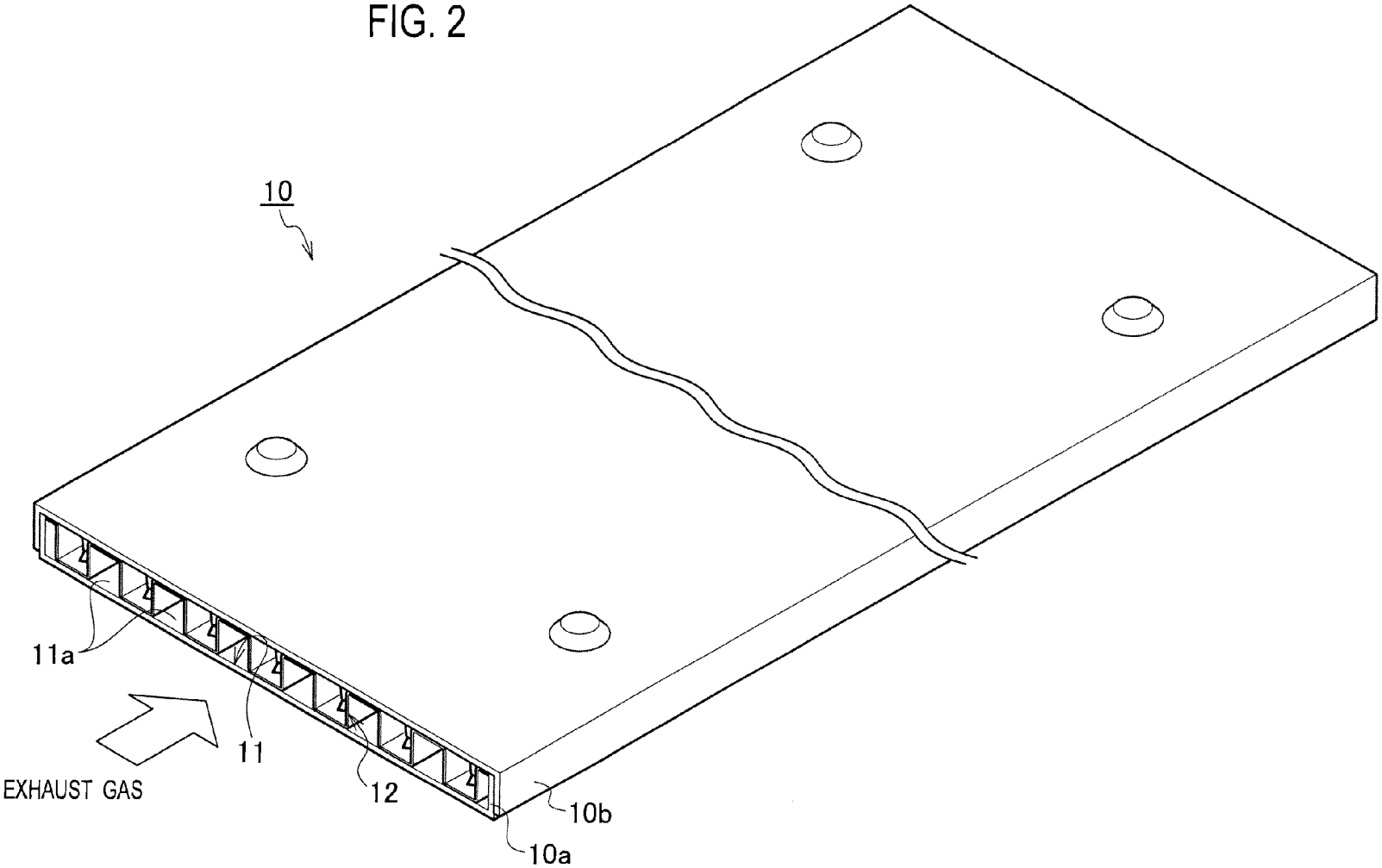
FIG. 2 It is a perspective view of a tube in the exhaust gas heat exchanger shown in FIG. 1.

The tubes 10 are stacked. As shown in FIG. 2, each of the tubes 10 is formed by two flat members 10*a* and 10*b*. An exhaust gas flow path 11 is formed within each of the tubes 10, and the exhaust gas flow path 11 is segmented into plural segmented flow channels 11*a* by a fin 12. The plural segmented flow channels 11*a* are aligned along a perpendicular direction to an exhaust gas flow direction S. Each of the segmented flow channels 11*a* has plural inner surfaces along the exhaust gas flow direction S (four inner surfaces including one inner surface of the tube 10 and three inner surfaces of the fin 12).

Figure 3:
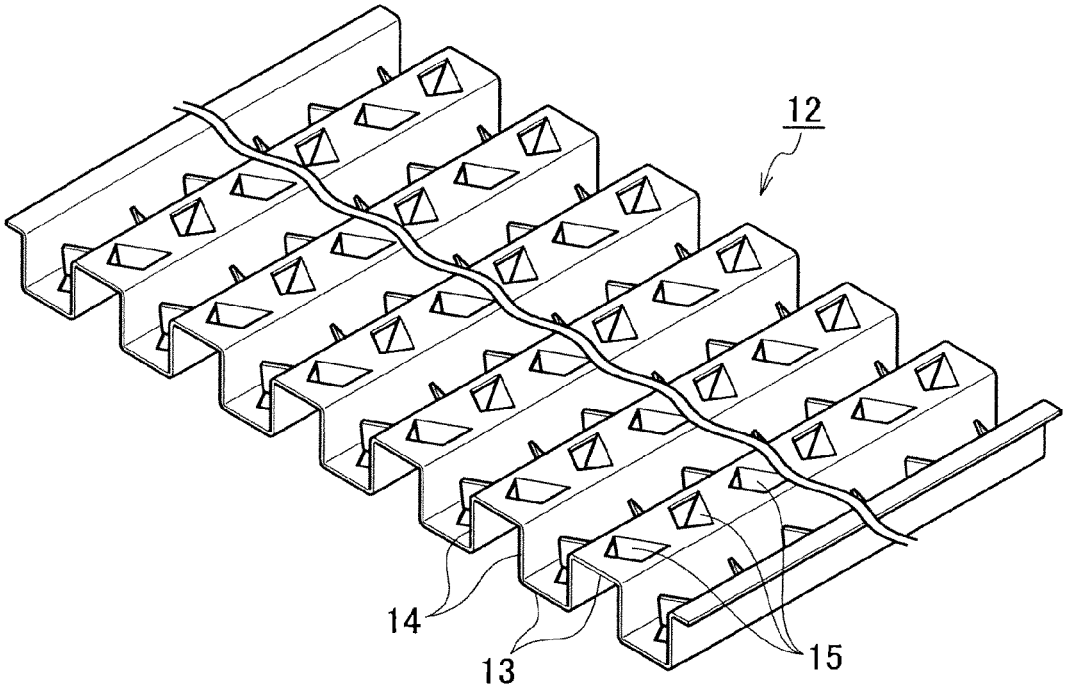
FIG. 3 (*a*) is a perspective view of a fin in the tube, and (*b*) is a partially enlarged front view of the fin.
Figure 3:
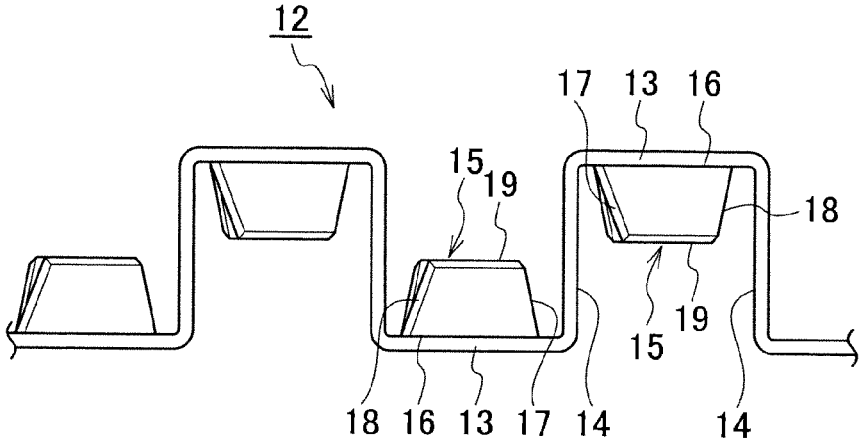

As shown in FIGS. 3(*a*) and (*b*), the fin 12 is made by a corrugated panel having a rectangular outline shape in which horizontal walls 13 and vertical walls 14 are alternately-connected. Each of the horizontal walls 13 is appressed to an inner surface of the tube 10. Each of the vertical walls 14 segments the exhaust gas flow path 11 into the plural segmented flow channels 11*a*. In each of the segmented flow channels 11*a*, plural protruded tabs 15 are cut and raised at intervals along the exhaust gas flow direction S. Each of the protruded tabs 15 is protruded so as to inhibit an exhaust gas flow in the exhaust gas flow path 11. Namely, the protruded tabs 15 are protruded in a perpendicular direction to the exhaust gas flow direction S, and inclined against the exhaust gas flow direction S.

Figure 4:
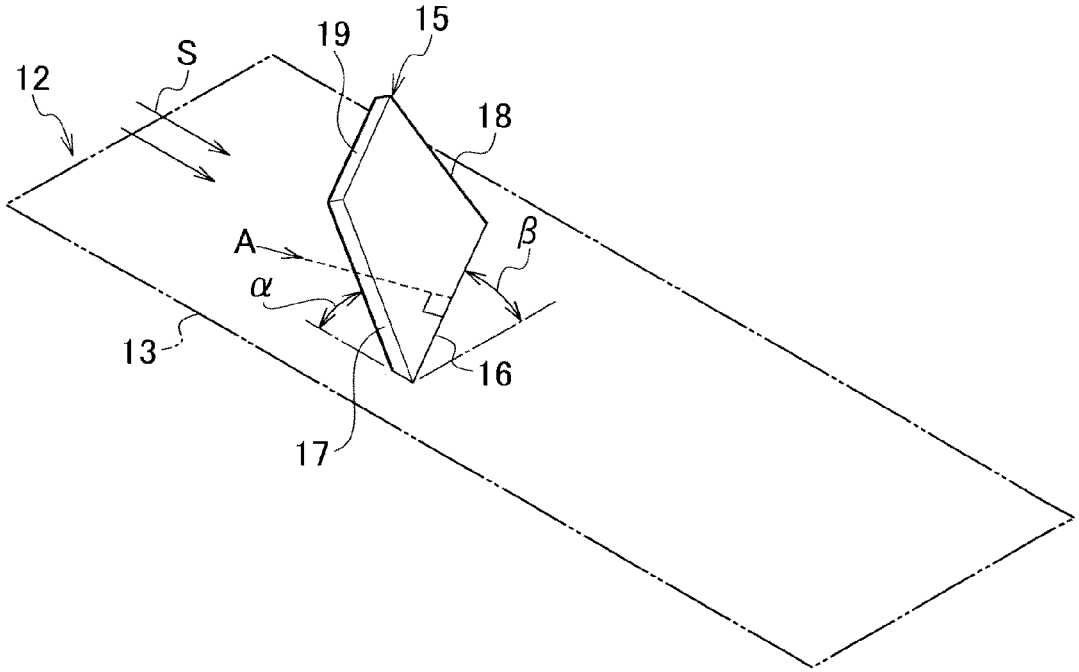
FIG. 4 It is a perspective view of a protruded tab on the fin.
Figure 5:
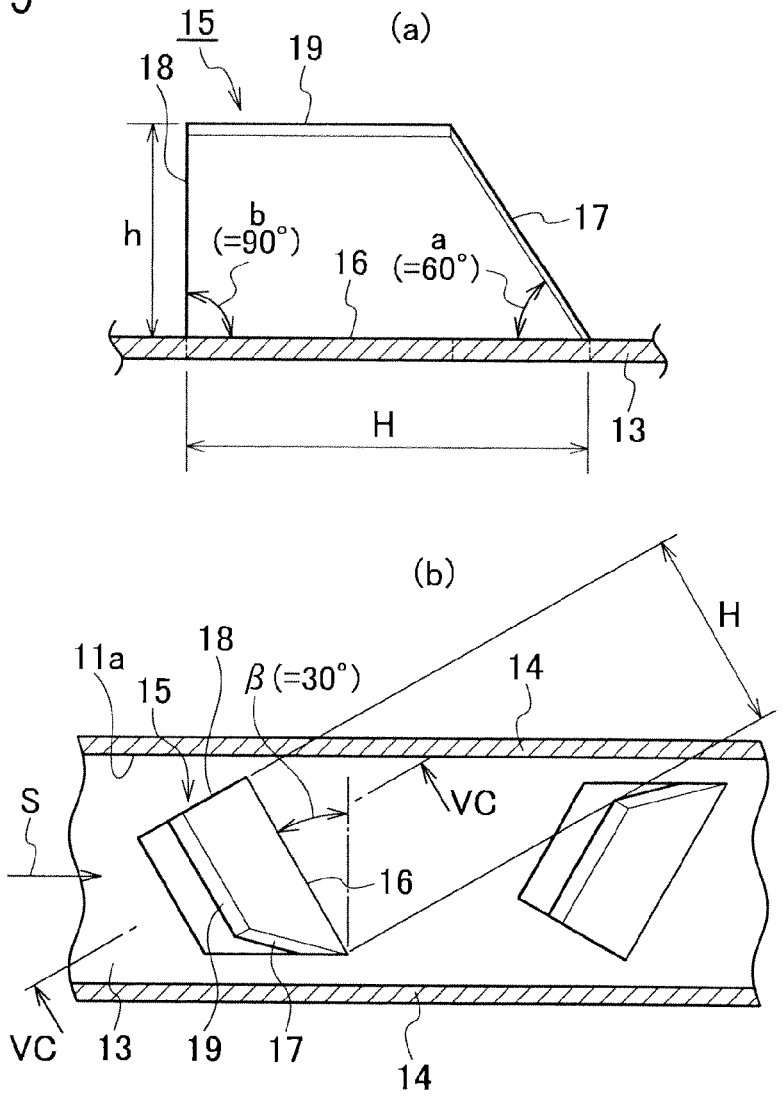
FIG. 5 (*a*) is a front view of the protruded tab viewed from a direction A in FIG. 4, (*b*) is a plan view of the protruded tab, and (*c*) is a cross-sectional view taken along a line VC-VC in FIG. 5(*b*).

As shown in FIG. 4 and FIG. 5(*a*)-(*c*), the protruded tab 15 has a trapezoidal shape including a bottom side 16, one lateral side 17, another lateral side 18 and a top side 19. An angle a of the one lateral side 17 to the bottom side 16 is set smaller than an angle b of the other lateral side 18 to the bottom side 16, specifically, set to smaller than 90 degrees. In the present embodiment, the angle a of the one lateral side 17 is set to 60 degrees, and the angle b of the other lateral side 18 is set to 90 degrees (see FIG. 5(*a*)). Note that the angles a and b are angles on a surface of the protruded tab 15.

In addition, the protruded tab 15 is inclined to an upstream side along the exhaust gas flow direction S so as to have an angle $\alpha$ ($0<\alpha<90°$ to the horizontal wall 13 of the fin 12 (see FIG. 5(*c*)). In the present embodiment, the inclined angle $\alpha$ is set to 60 degrees. Further, the protruded tab 15 is placed so that the bottom side 16 intersects with a perpendicular direction to the exhaust gas flow direction S. Namely, the bottom side 16 is placed so as to have an angle $\beta$ ($0<\beta<90$)° to the perpendicular direction to the exhaust gas flow direction S (intersecting angle with the perpendicular direction) (see FIG. 5(*b*)). In the present embodiment, the placement angle $\beta$ is set to 30 degrees. According to the above-explained placement angle $\beta$, the protruded tab 15 is placed obliquely so that the other lateral side 18 is located upstream from the one lateral side 17. The plural protruded tabs 15 aligned along the exhaust gas flow direction S are arranged so that their angular orientations are alternately-reversed (see FIG. 3(*a*) and FIG. 5(*b*)). In addition, two protruded tabs 15 adjacent side by side have a mirrored-image relationship with respect to their shapes. Note that the protruded tab(s) 15 in the present embodiment has a trapezoidal (quadrilateral) shape, but the protruded tab(s) may have a polygonal shape more than a quadrilateral shape.

The exhaust gas from the internal combustion engine flows through the exhaust gas flow path 11 in each of the tubes 10. The coolant flows through the coolant flow path 5 in the outer case 2. The exhaust gas and the coolant exchange heat via the tubes 10 and the fin 12. At this heat exchange, the exhaust gas flow is agitated by the protruded tabs 15 on the fin 12, and thereby the heat exchange is facilitated.

Figure 6:
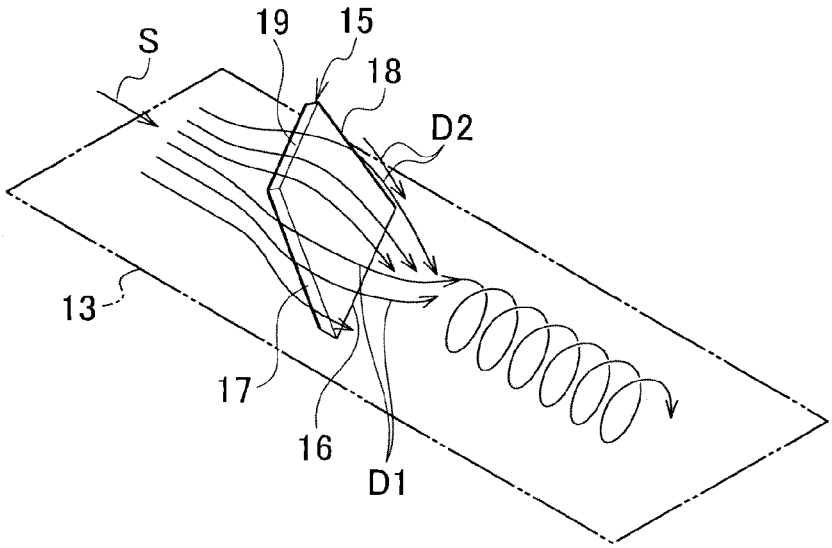
FIG. 6 (*a*) is a perspective view showing a first flow and a second flow flowing over the protruded tab, (*b*) is a plan view showing the first flow and the second flow, and (*c*) is a back view showing a swirl flow generated by the first flow and the second flow and viewed from its downstream side.
Figure 6:
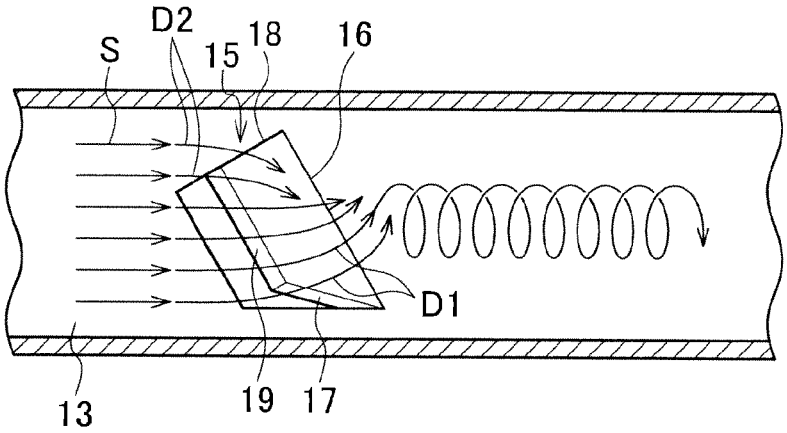
Figure 6:
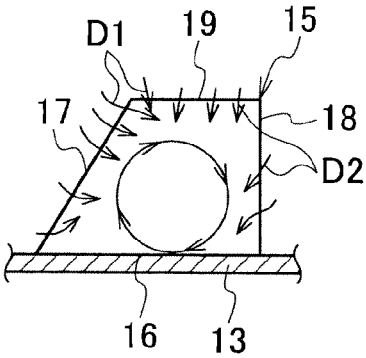

As shown in FIGS. 6(*a*) and (*b*), since the exhaust gas flowing through the exhaust gas flow path 11 cannot flow straight due to the protruded tab(s) 15, a low pressure area is generated just downstream of the protruded tab 15. Since the protruded tab 15 has a trapezoidal shape, an area for blocking the exhaust gas flow is large. Therefore, the low pressure area whose pressure is sufficiently low is generated just downstream of the protruded tab 15.

In addition, due to the different angles a and h of the lateral sides 17 and 18 of the protruded tab 15, a flow amount of a first flow D1 that flows over the one lateral side 17 and the top side 19 nearby the one lateral side 17 and then flows around behind the protruded tab 15 becomes larger than a flow amount of a second flow D2 that flows over the other lateral side 18 and the top side 19 nearby the other lateral side 18 and then flows around behind the protruded tab 15. As a result, a flow amount of the first flow D1 at an upper portion of the inclination of the one lateral side 17 becomes larger than a flow amount at a lower portion of the inclination of the one lateral side 17. Due to this flow amount distribution, the first flow D1 is drawn strongly into the low pressure area. As a result, a single large strong swirl flow (spiral flow) is generated at a downstream of the protruded tab 15 as shown in FIG. 6(*c*).

In addition, the protruded tab(s) 15 is inclined by the inclined angle $\alpha$ to an upstream side along the exhaust gas flow direction S. Therefore, it can inhibit the exhaust gas flow more than a case where the protruded tab 15 is inclined to a downstream side, so that the large strong swirl flow can be generated. In the case where the protruded tab 15 is inclined to a downstream side, the exhaust gas flow flows over the top side 19 while changing its direction smoothly along a surface of the protruded tab 15 and then flows downstream. On the other hand, in the case where the protruded tab 15 is inclined to an upstream side, the exhaust gas flow is inhibited from flowing downstream, so that it is drawn around behind the protruded tab 15 as turbulence to generate the swirl flow effectively.

Further, the protruded tab(s) 15 is arranged obliquely so that the bottom side 16 has the angle $\beta$ to the perpendicular direction to the exhaust gas flow direction S and the other lateral side 18 is located upstream from the one lateral side 17. Therefore, the first flow D1 flowing over the one lateral side 17 is affected, just after flowing around behind the protruded tab 15, by a drawing force from the low pressure area. As a result, a large strong swirl flow can be generated while flow resistance is reduced.

As explained above, since the exhaust gas flow is agitated by the generation of the single large strong swirl flow for breaking laminar flows near the inner surfaces (the inner surfaces of the tube 10 and the horizontal walls 13 of the fin 12) of the exhaust gas flow path 11, heat transfer is facilitated effectively and thereby heat exchange efficiency can be improved.

The protruded tab (s) 15 in the present embodiment has a trapezoidal shape in which the angle a of the one lateral side 17 to the bottom side 16 is set to 60 degrees and the angle b of the other lateral side 18 to the bottom side 16 is set to 90 degrees. Therefore, the protruded tab 15 can be formed to have a simple shape, so that the protruded tab 15 can be formed easily by cutting and raising.

The exhaust gas flow path 11 is segmented into the plural segmented flow channels 11*a* by the fin 12, and the protruded tabs 15 are disposed at intervals along the exhaust gas flow direction S in each of the segmented flow channels 11*a*. Therefore, the swirl flow can be formed in each of the segmented flow channels 11*a*, and thereby heat exchange can be facilitated almost uniformly in every region of the exhaust gas flow path 11.

The plural protruded tabs 15 disposed along the exhaust gas flow direction S are arranged so that their angular orientations are alternately-reversed. Therefore, directions of the swirl flows generated downstream of the protruded tabs 15 made alternately-reversed, and thereby the exhaust gas flow can be agitated more effectively and heat exchange efficiency can be improved further.

Figure 7:
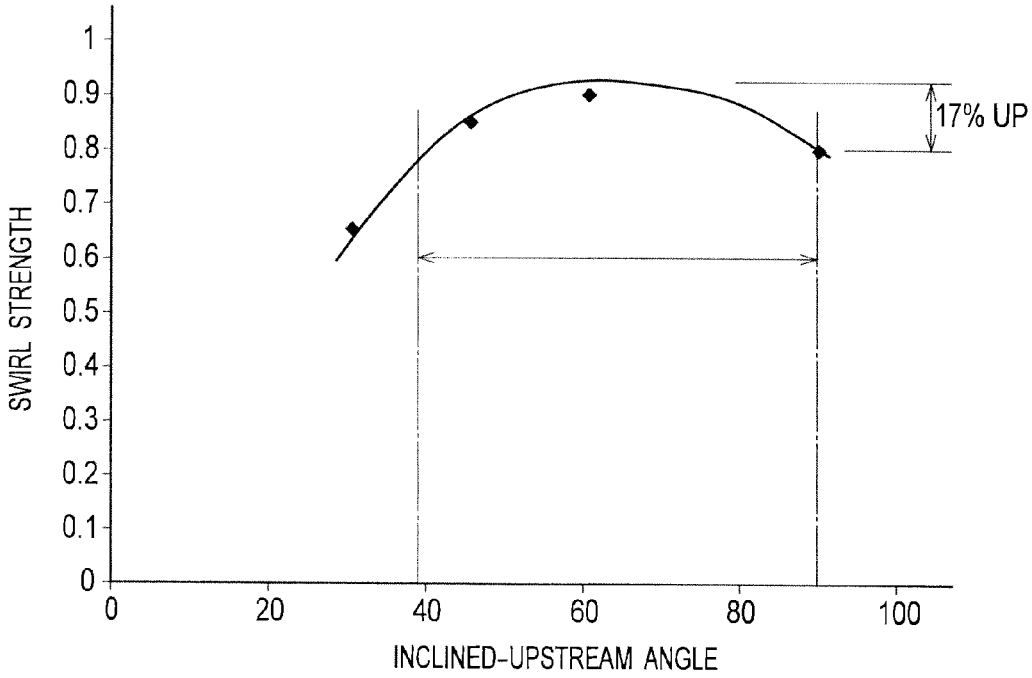
FIG. 7 It is a characteristic diagram showing relationship between an inclined angle $\alpha$ of the protruded tab and swirl strength.

A characteristic diagram showing the relationship between the inclined angle α of the protruded tab 15 and swirl strength is shown in FIG. 7. Here, a shape of the protruded tabs) 15 is the above-explained trapezoidal shape, and its placement angle β is set to 0 degree (perpendicular to the exhaust gas flow direction S). The swirl strength $I_V$ is calculated by a Formula 1 shown below.

$$\text{Swirl Strength } Iv=\int I_A dx'(x'=x/h) \quad \text{[Formula 1]}$$

The x in the above formula is a coordinate along the exhaust gas flow direction S with its origin at a placed position of the protruded tab 15 (position where the swirl is generated), and the h is a height of the protruded tab 15 (see FIG. 5(*c*)). $I_A$ is, when the second invariant Q of the velocity gradient tensor of a flow-path cross-section of the exhaust gas flow is plus, a "value per unit area of Q".

When α=90°, β=0 and the protruded tab has a triangle shape, the swirl strength $I_v$ is 0.8. According to the characteristic diagram shown in FIG. 7, in the present embodiment, a stronger swirl flow is generated as long as in a range of 40°≤α<90° than a swirl flow(s) by the triangle protruded tab, and α=60° is most preferable. When α=60°, a 17%-stronger swirl flow is generated than a swirl flow(s) by the triangle protruded tab. From this result, it is understood that, in the range of 40°≤α<90', a stronger swirl can be generated surely by the effect of the inclined angle α than a swirl flow(s) by the triangle protruded tab.

Figure 8:
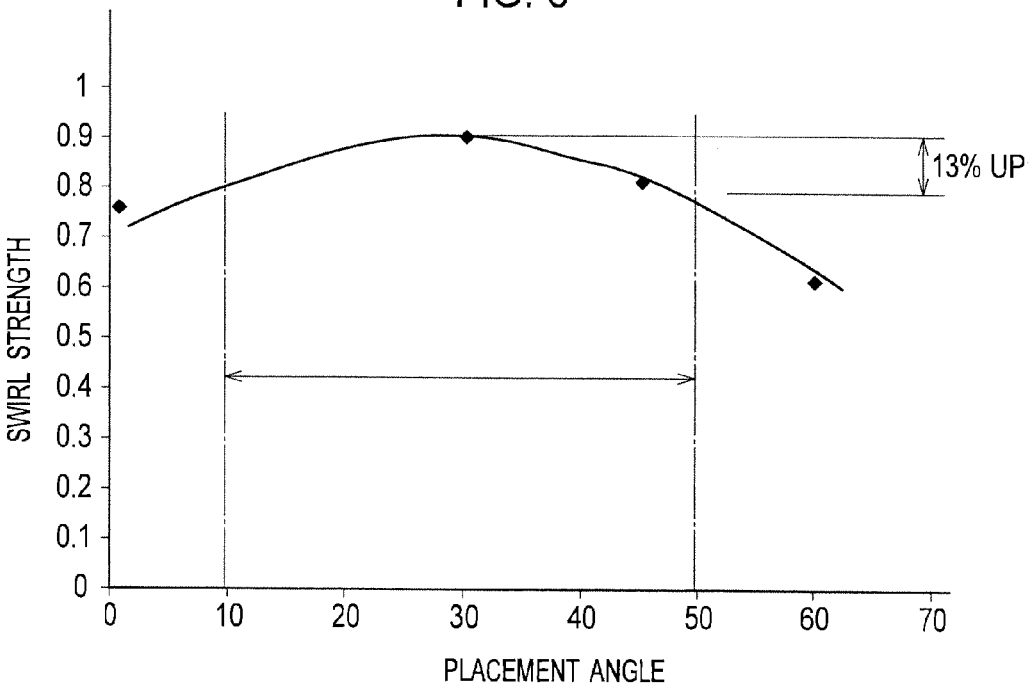
FIG. 8 It is a characteristic diagram showing relationship between a placement angle $\beta$ of the protruded tab and the swirl strength.

A characteristic diagram showing the relationship between the placement angle β of the protruded tab 15 and the swirl strength is shown in FIG. 8. Here, a shape of the protruded tab(s) 15 is the above-explained trapezoidal shape, and its inclined angle a is set to 90 degrees. The swirl strength $I_V$ is calculated by the above formula.

When α=90°, β=0 and the protruded tab has a triangle shape, the swirl strength $I_v$ is 0.8. According to the characteristic diagram shown in FIG. 8, in the present embodiment, a stronger swirl flow is generated as long as in a range of 10°≤β<50° than a swirl flow(s) by the triangle protruded tab, and β=30° is most preferable. When β=30', a 13%-stronger swirl flow is generated than a swirl flow(s) by the triangle protruded tab. From this result, it is understood that, in the range of 10°≤β<50°, a stronger swirl can be generated surely by the effect of the placement angle β than a swirl flow(s) by the triangle protruded tab.

Figure 9:
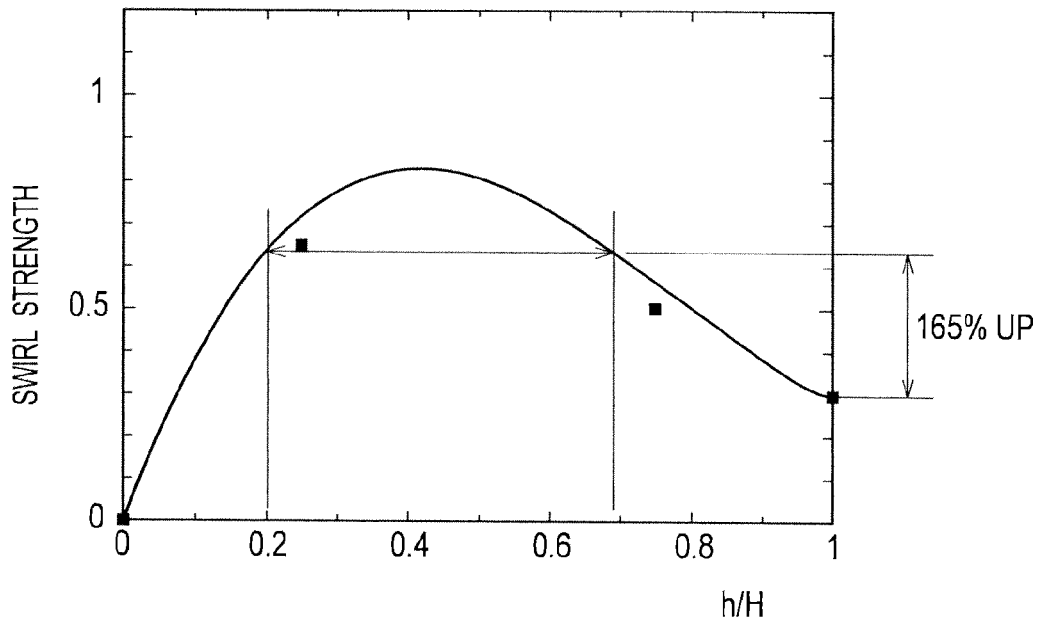
FIG. 9 It is a characteristic diagram showing relationship between an h/H value of the protruded tab and the swirl strength.

A characteristic diagram showing relationship between a ratio of the height h (see FIG. 5(*c*)) of the of the protruded tab 15 to the length H (see FIG. 5(*b*)) of the bottom side 16 of the protruded tab 15 and the swirl strength is shown in FIG. 9. A triangle protruded tab is almost equivalent to a case of (h/H)=1, so that its swirl strength $I_v$ is 0.3. In the present embodiment, a range of 0.2≤(h/H)<0.7 is preferable, and a 165%-stronger swirl flow can be generated in this range than a swirl flow(s) by the triangle protruded tab.

Figure 10:
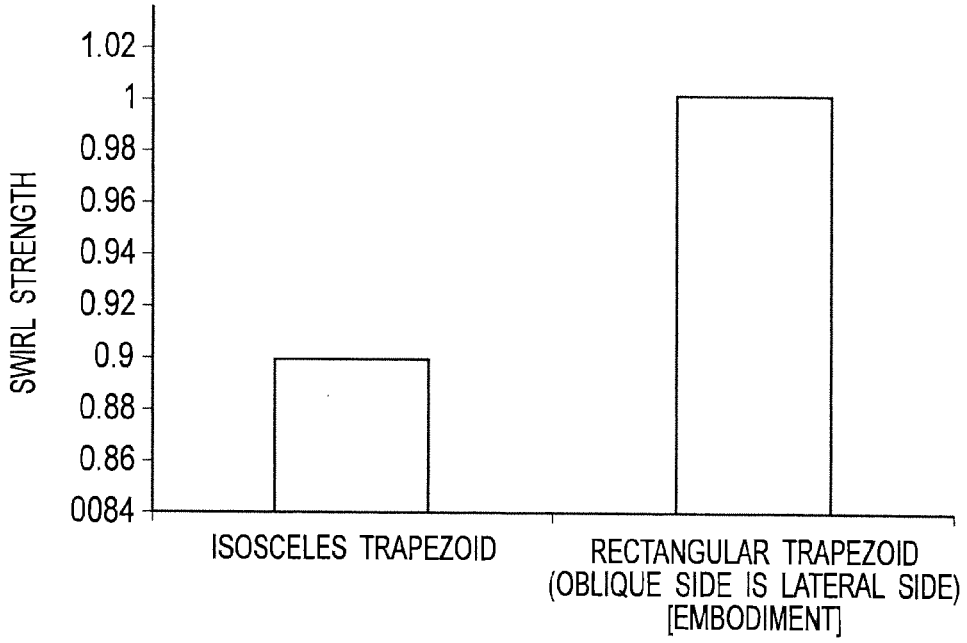
FIG. 10 It is a diagram showing the swirl strengths by an isosceles trapezoidal protruded tab and a rectangular trapezoidal protruded tab.

A histogram showing comparison between the swirl strength by an isosceles trapezoidal protruded tab in which the angles a and b of the lateral sides 17 and 18 are equal to each other and the swirl strength by the rectangular trapezoidal protruded tab 15 in the present embodiment is shown in FIG. 10. As understood from FIG. 10, the protruded tab 15 in the present embodiment can generate a stronger swirl flow due to the above explained generation process of the swirl flow.

Second Embodiment

Figure 11:
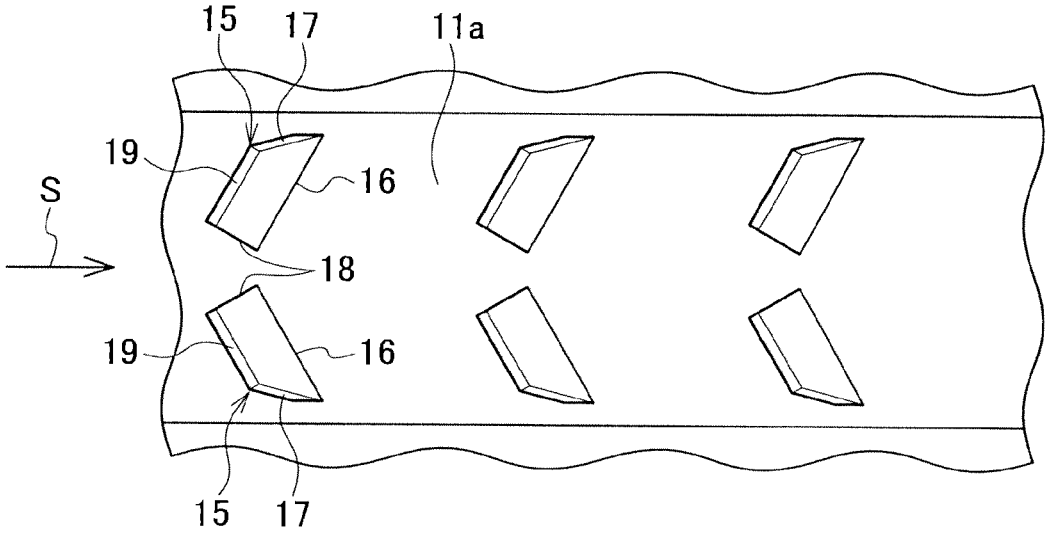
FIG. 11 (*a*) is a plan view showing an arrangement pattern in an exhaust gas heat exchanger according to a second embodiment, and (*b*) is a plan view showing an arrangement pattern in an exhaust gas heat exchanger according to a third embodiment.
Figure 11:
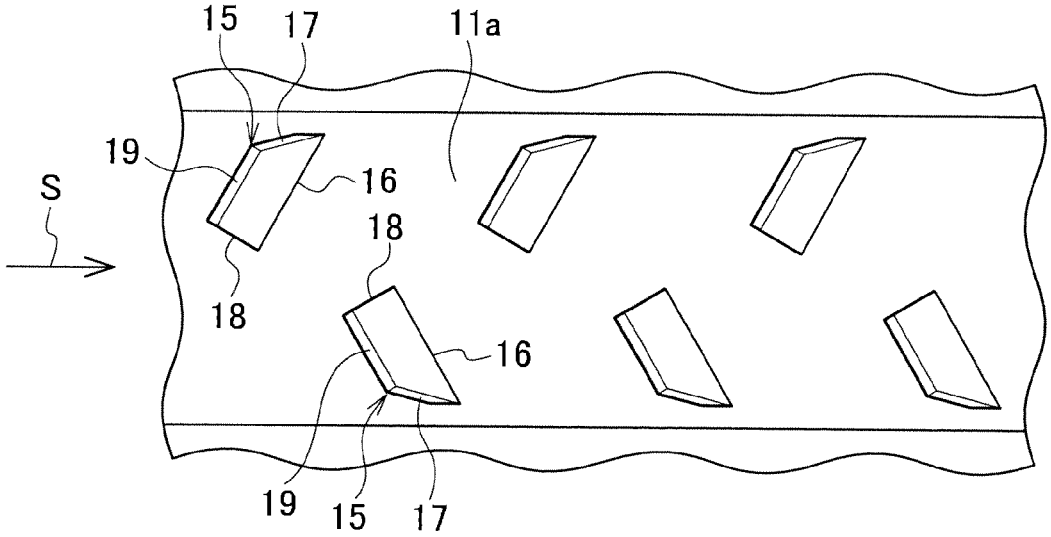

An exhaust heat exchanger according to a second embodiment will be explained with reference to FIG. 11(*a*). In the present embodiment, every two protruded tabs 15 are adjacent side by side along a perpendicular direction to the exhaust gas flow direction S in the segmented flow channel 11*a*. The adjacent two protruded tabs 15 have line-symmetrical shapes to each other with respect to the exhaust gas flow direction S. In each of the protruded tabs 15, the other lateral side 18 is located on the center of the segmented flow channel 11*a*. In addition, each of the protruded tabs 15 is placed obliquely so that the other lateral side 18 is located upstream from the one lateral side 17. Since other configurations are equivalent to those in the first embodiment, their redundant explanations are omitted.

According to the present embodiment, two swirl flows having different directions from each other are generated downstream of the adjacent protruded tabs 15. Therefore, the two swirl flows don't weaken each other even when they become close to each other and affect each other, so that heat exchange efficiency is improved.

A following configuration may be adopted as a modified example of the present embodiment. Every two protruded tabs 15 are adjacent along a perpendicular direction to the exhaust gas flow direction S in the segmented flow channel 11*a*. The adjacent protruded tabs 15 have line-symmetrical shapes to each other with respect to the exhaust gas flow direction S. However, in each of the protruded tabs 15, the one lateral side 17 is located on the center of the segmented flow channel 11*a*. And, each of the protruded tabs 15 is placed obliquely so that the other lateral side 18 is located upstream from the one lateral side 17.

Third Embodiment

An exhaust heat exchanger according to a third embodiment will be explained with reference to FIG. 11 (*b*). In the present embodiment, the protruded tabs 15 are aligned alternately on both sides of the center of the segmented flow channel 11*a* along the exhaust gas flow direction S in the segmented flow channel 11*a*. Each of the protruded tabs 15 on one side of the center of the segmented flow channel 11*a* and each of the protruded tabs 15 on another side have line-symmetrical shapes to each other with respect to the exhaust gas flow direction S. In each of the protruded tabs 15, the other lateral side 18 is located on the center of the segmented flow channel 11*a*. In addition, each of the protruded tabs 15 is placed obliquely so that the other lateral side 18 is located upstream from the one lateral side 17. Since other configurations are equivalent to those in the first embodiment, their redundant explanations are omitted.

According to the present embodiment, swirl flows having different directions from each other are generated alternately along the exhaust gas flow direction S in the segmented flow channel 11*a*. Therefore, the exhaust gas flow in the segmented flow channel 11*a* is agitated further, so that heat exchange efficiency is improved.

A following configuration may be adopted as a modified example of the present embodiment. The protruded tabs 15 are aligned alternately on both sides of the center of the segmented flow channel 11*a* along the exhaust gas flow direction Sin the segmented flow channel 11*a*. Each of the protruded tabs 15 on one side of the center of the segmented flow channel 11*a* and each of the protruded tabs 15 on another side have line-symmetrical shapes to each other with respect to the exhaust gas flow direction S. However, in each of the protruded tabs 15, the one lateral side 17 is located on the center of the segmented flow channel 11*a*. And, each of the protruded tabs 15 is placed obliquely so that the other lateral side 18 is located upstream from the one lateral side 17.

Fourth Embodiment

Figure 12:
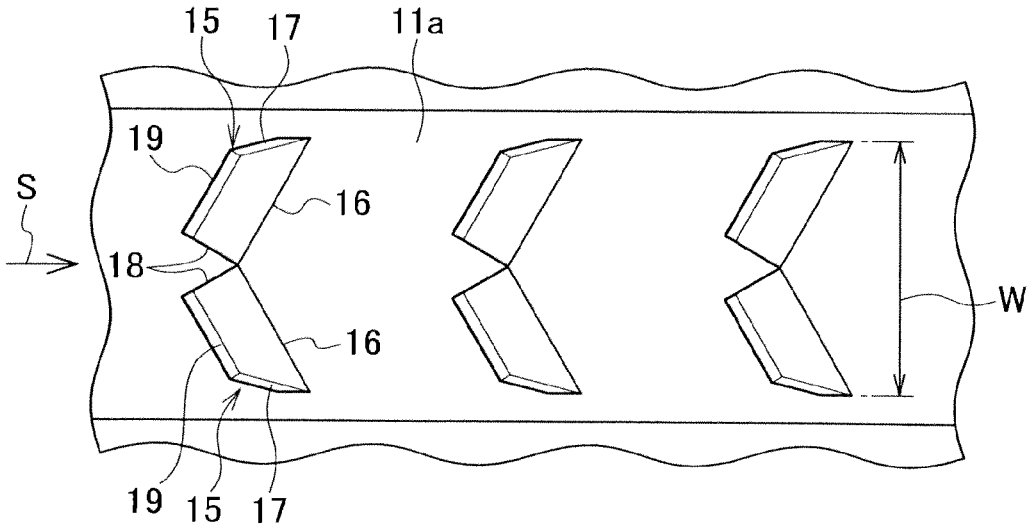
FIG. 12 (*a*) is a plan view showing an arrangement pattern in an exhaust gas heat exchanger according to a fourth embodiment, and (*b*) is a plan view showing an arrangement pattern in an exhaust gas heat exchanger according to a fifth embodiment.
Figure 12:
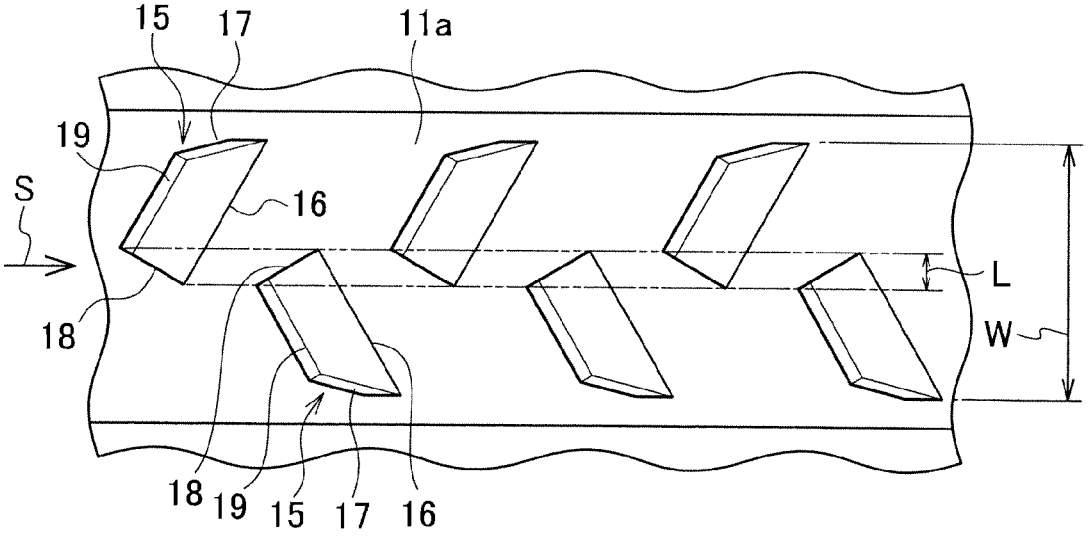

An exhaust heat exchanger according to a fourth embodiment will be explained with reference to FIG. 12(*a*). An arrangement pattern of the protruded tabs 15 in the present embodiment is similar to that in the above-explained second embodiment. However, the bottom sides 16 of the two protruded tabs 15 adjacent side by side are contacted with each other. Since other configurations are equivalent to those in the first embodiment, their redundant explanations are omitted.

According to the present embodiment, equivalent advantages achieved by the above-explained second embodiment are achieved. In addition, since a placement width of the protruded tabs 15 can be narrowed, it is effective for an arrangement of the protruded tabs 15 in a narrow segmented flow channel 11*a*. As a modified example of the present embodiment, the one lateral side 17 of each of the protruded tabs 15 may be located on the center of the segmented flow channel 11*a*, and each of the protruded tabs 15 is placed obliquely so that the other lateral side 18 is located upstream from the one lateral side 17. Further, more than two protruded tabs may be aligned along the perpendicular direction to the exhaust gas flow direction S.

Fifth Embodiment

An exhaust heat exchanger according to a fifth embodiment will be explained with reference to FIG. 12 (*b*). An arrangement pattern of the protruded tabs 15 in the present embodiment is similar to that in the above-explained third embodiment. However, neighboring two protruded tabs 15 along the exhaust gas flow direction S are overlapped at the center of the segmented flow channel 11*a* (see L in FIG. 12 (*b*)). Since other configurations are equivalent to those in the first embodiment, their redundant explanations are omitted.

According to the present embodiment, equivalent advantages achieved by the above-explained third embodiment are achieved. In addition, since a placement width of the protruded tabs 15 can be narrowed, it is effective for an arrangement of the protruded tabs 15 in a narrow segmented flow channel 11*a*. As a modified example of the present embodiment, the one lateral side 17 of each of the protruded tabs 15 may be located on the center of the segmented flow channel 11*a*, and each of the protruded tabs 15 is placed obliquely so that the other lateral side 18 is located upstream from the one lateral side 17.

Sixth Embodiment

Figure 13:
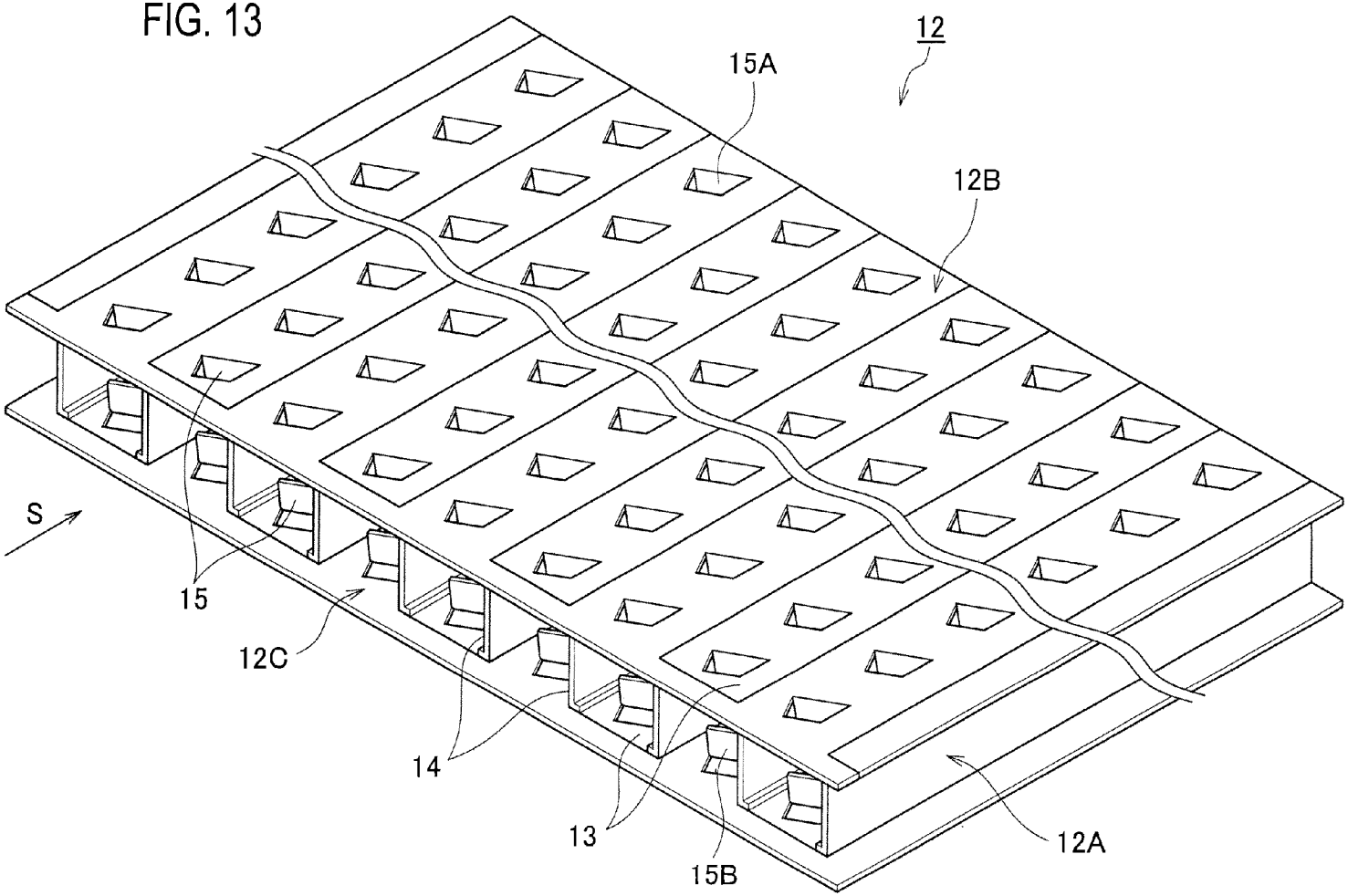
FIG. 13 It is a perspective view of a fin in an exhaust gas heat exchanger according to a sixth embodiment.
Figure 14:
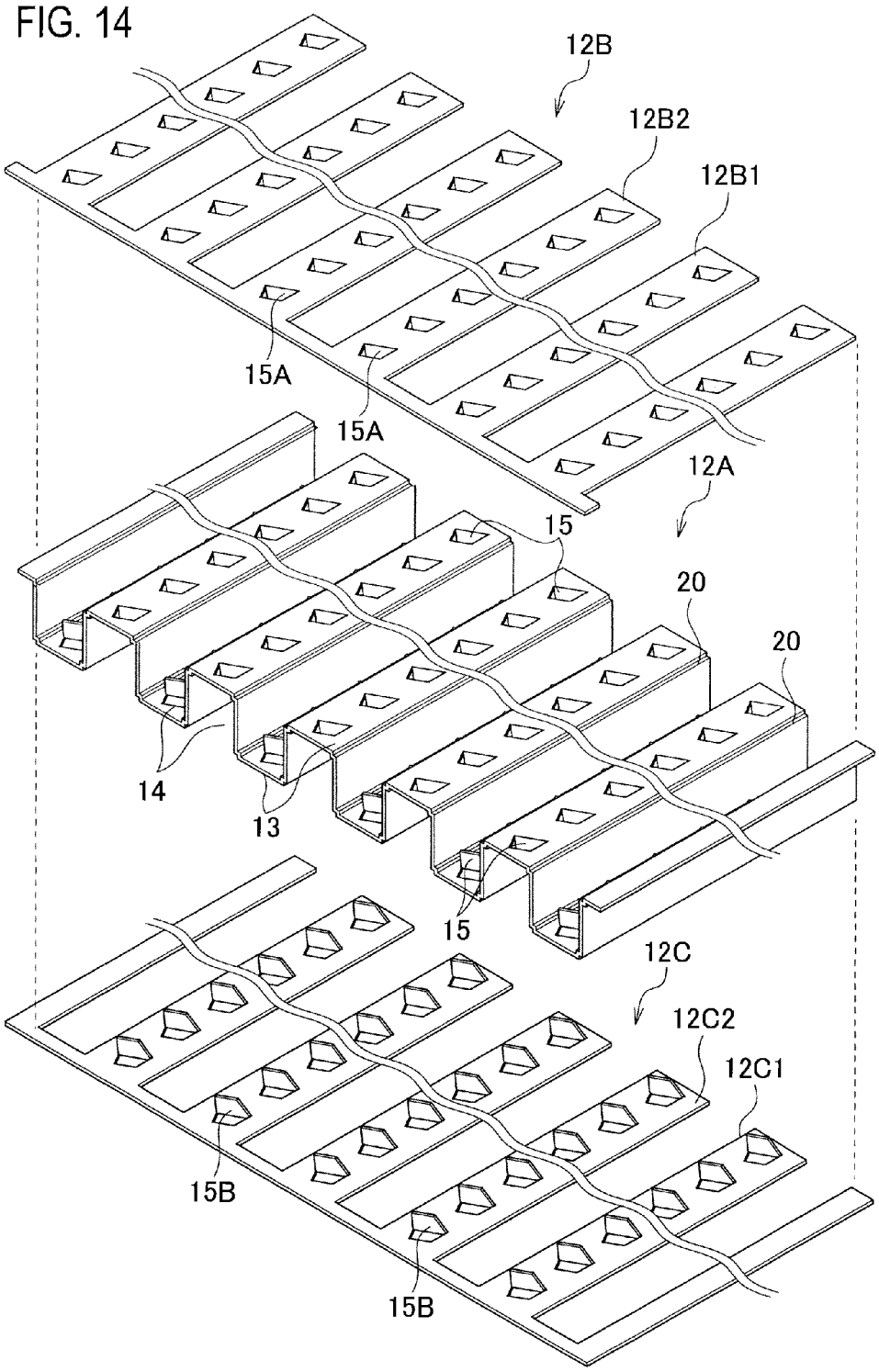
FIG. 14 It is an exploded perspective view of the fin.

An exhaust heat exchanger according to a sixth embodiment will be explained with reference to FIG. 13 to FIG. 15(*c*). Each shape of the protruded tabs 15, 15A and 15B in the present embodiment is identical to that in the above-explained first embodiment. However, the protruded tabs 15, 15A and 15B are formed on two inner surfaces of plural inner surfaces (four inner surfaces) of the segmented flow channel 11*a*. The fin 12 in the present embodiment is configured of a fin main member 12A that is a corrugated panel having a rectangular outline shape and in which horizontal walls 13 and vertical walls 14 are alternately-connected, a first plate member 12B attached to one side of the fin main member 12A, and a second plate member 12C attached to another side of the fin main member 12A.

The protruded tabs 15 identical to those in the first embodiment are formed on the fin main member 12A (but angular orientations of all the protruded tabs 15 are identical). Steps 20 are formed along connection portions with the horizontal walls 13 and the vertical walls 14. A depth $D_{20}$ of the step(s) 20 is almost identical to a thickness $D_{12B}$ of the first plate member 12B and a thickness $D_{12C}$ of the second plate member 12C (see FIG. 15(*a*)). Since other configurations of the fin main member 12A are equivalent to configurations of the fin 12 in the first embodiment, their redundant explanations are omitted.

First cutouts 12B1 are formed on the first plate member 12B so as to be associated with upper (in the drawing) horizontal walls 13 of the fin main member 12A. First lids 12B2 facing to lower horizontal walls 13 are formed between the first cutouts 12B1. On the first lid(s) 12B2, plural protruded tabs 15A are cut and raised at intervals along the exhaust gas flow direction S. Each of the protruded tabs 15A is protruded (toward the lower horizontal wall 13) so as to inhibit the exhaust gas flow in the exhaust gas flow path 11. Since other configurations of the protruded tab 15A are equivalent to configurations of the protruded tab 15 on the fin main member 12A (i.e. the protruded tab 15 in the first embodiment), their redundant explanations are omitted.

Second cutouts 12C1 are formed on the second plate member 12C so as to be associated with lower (in the drawing) horizontal walls 13 of the fin main member 12A. Second lids 12C2 facing to upper horizontal walls 13 are formed between the second cutouts 1201. On the second lid(s) 12C2, plural protruded tabs 15B are cut and raised at intervals along the exhaust gas flow direction S. Each of the protruded tabs 15B is protruded (toward the upper horizontal wall 13) so as to inhibit the exhaust gas flow in the exhaust gas flow path 11. Since other configurations of the protruded tab 15B are equivalent to configurations of the protruded tab 15 on the fin main member 12A (i.e. the protruded tab 15 in the first embodiment), their redundant explanations are omitted.

Figure 15:
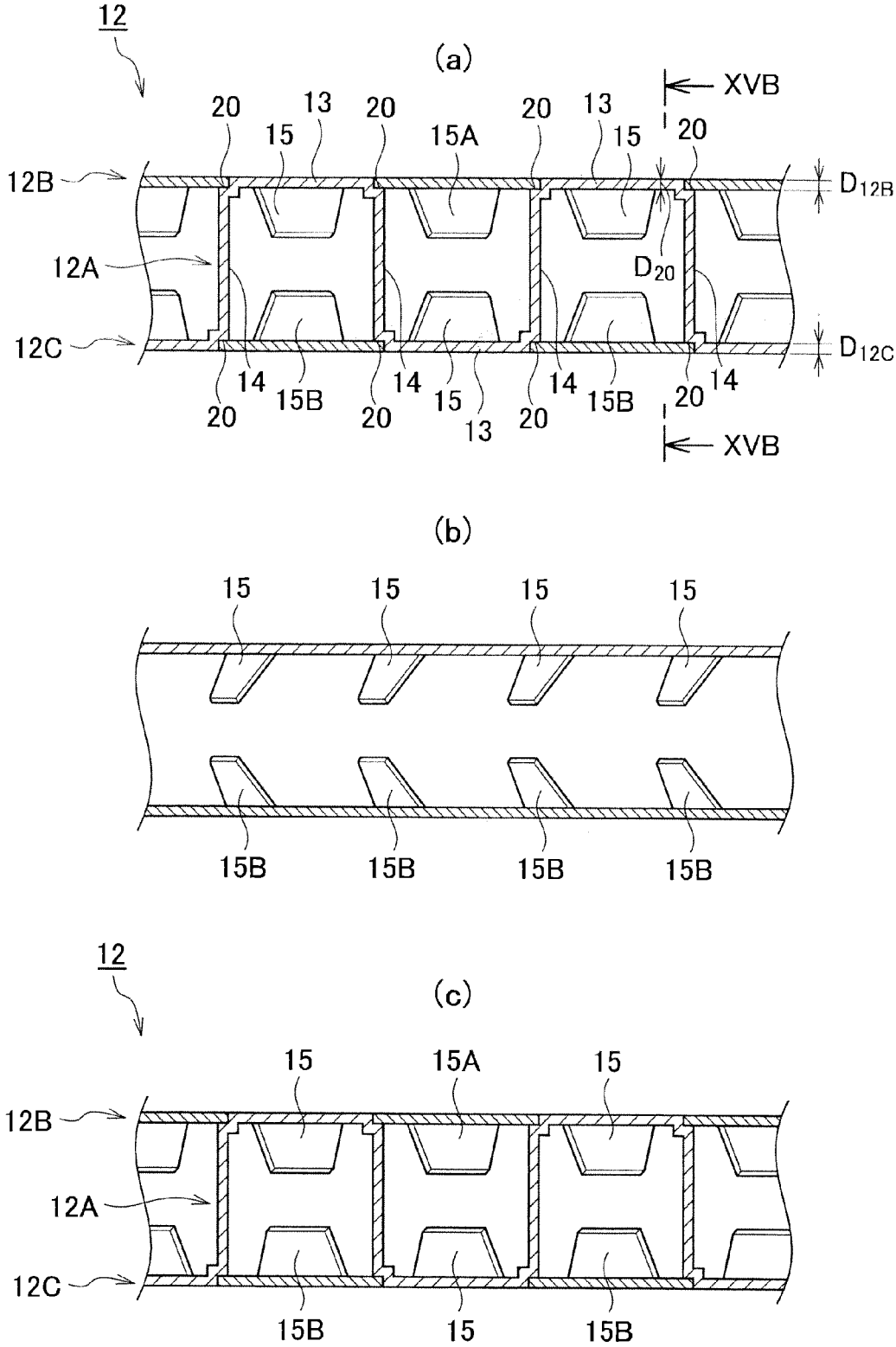
FIG. 15 (*a*) is a partially enlarged cross-sectional view of the fin, (*b*) is a cross-sectional view taken along a line XVB-XVB in FIGS. 15(*a*), and (*c*) is a partially enlarged cross-sectional view of a modified example of the fin.

As shown in FIG. 15(*a*), angular orientations of the protruded tabs 15A and 15B are identical to the angular orientations of the protruded tabs 15 on the fin main member 12A. In addition, as shown in FIG. 15(*b*), the protruded tabs 15A and 15B and the protruded tabs 15 on the fin main member 12A are disposed at identical locations along the exhaust gas flow direction S.

According to the present embodiment, the protruded tabs 15, 15A and 15B are formed on the two inner surfaces facing to each other (on the lower horizontal walls 13 and the first lids 12B2, and on the upper horizontal walls 13 and the second lids 12C2) among the plural inner surfaces of the exhaust gas flow path 11. Further, back surfaces of the two inner surfaces facing to each other on which the protruded tabs 15, 15A and 15B are formed are planarly contacted with the inner surfaces of the tube 10. Therefore, the exhaust gas flow is agitated by the generation of the swirl flow for breaking laminar flows near the inner surfaces of the horizontal walls 13, the first lids 12B2 and the second lids 12C2 that are planarly contacted with the tube 10, so that heat transfer is facilitated effectively and thereby heat exchange efficiency can be improved further.

In addition, the first plate member 12B and the second plate member 12C are formed as a single member, respectively, in the present embodiment. Therefore, compared with a case where the first lids 12B2 and the second lids 12C2 are prepared for each of the segmented flow channels 11*a* one by one, workability for attaching the first plate member 12B and the second plate member 12C to the fin main member 12A becomes superior.

Further, the depth $D_{20}$ of the step(s) 20 is almost identical to the thickness $D_{12B}$ of the first plate member 12B and the thickness $D_{12C}$ of the second plate member 12C in the present embodiment. Therefore, outer surfaces of the fin 12 becomes flat after the first plate member 12B and the second plate member 12C are attached to the fin main member 12A, so that the fin 12 can be disposed in the exhaust gas flow path 11 efficiently. In addition, heat transfer can be facilitated by increasing contact areas between the fin 12 and the tube 10.

Furthermore, the angular orientations of the protruded tabs 15A and 15B are made identical to the angular orientations of the protruded tabs 15 in the present embodiment. Therefore, swirl flows generated by the protruded tabs 15, 15A and 15B swirl in an identical direction, so that heat exchange efficiency can be improved further.

A modified example of the present embodiment is shown in FIG. 15(*c*). In this modified example, the angular orientations of the protruded tabs 15A and 155 are made reversed to the angular orientations of the protruded tabs 15 on the fin main member 12.

Note that it is not necessarily that the protruded tabs 15A and 155 and the protruded tabs 15 on the fin main member 12A are disposed at identical locations along the exhaust gas flow direction S, and the protruded tabs 15A and 15B and the protruded tabs 15 may be disposed alternately. In addition, it is not necessarily that the protruded tabs 15A and 15B have configurations identical to configurations of the protruded tabs 15 in the first embodiment, and the protruded tabs 15A and 15B may have configurations identical to configurations of the protruded tabs 15 in the second to fifth embodiments. Further, the protruded tabs 15, 15A and 15B are disposed on the two inner surfaces of the segmented flow channel 11*a*, but may be disposed on more than two surfaces (i.e. three or four inner surfaces).

Seventh Embodiment

Figure 16:
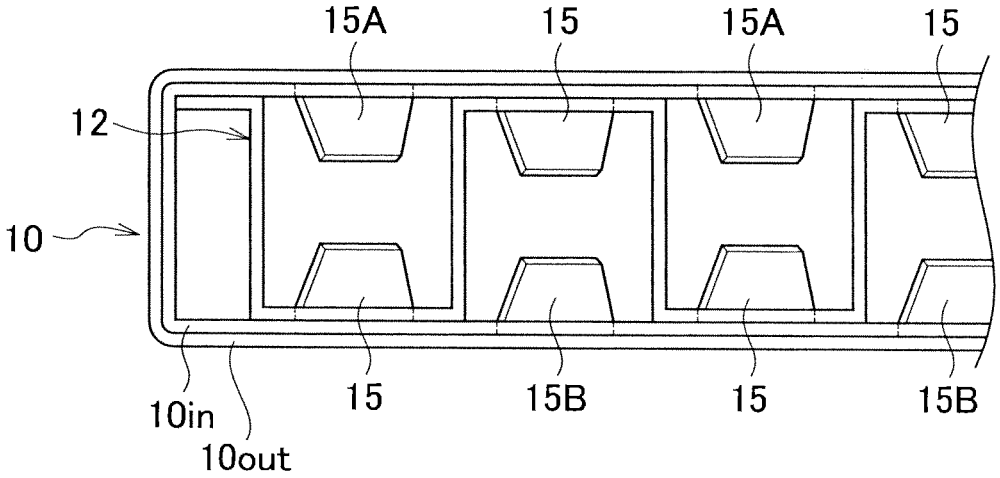
FIG. 16 It is a partially enlarged cross-sectional view of a tube in an exhaust gas heat exchanger according to a seventh embodiment.

An exhaust heat exchanger according to a seventh embodiment is shown in FIG. 16. The protruded tabs 15, 15A and 15B in the present embodiment are formed on two inner surfaces among plural inner surfaces (four surfaces) of the segmented flow channel 11*a* similarly to the above-explained sixth embodiment. In the present embodiment, the protruded tab 15 are disposed on the fin 12 (fin main member 12A), but the protruded tabs 15A and 15B facing to the protruded tabs 15 on the fin 12 are disposed on the tube 10. In detail, the tube 10 is configured of two layers, an inner layer 10in and an outer layer 10out, and the protruded tabs 15A and 15B are disposed on the inner layer 10 in. Since other configurations of the protruded tabs 15, 15A and 15B are equivalent to configurations of the protruded tabs 15, 15A and 15B in the sixth embodiment, their redundant explanations are omitted.

According to the present embodiment, equivalent advantages achieved by the above-explained sixth embodiment are achieved. In addition, the protruded tabs 15A and 15B can be disposed on the tube 10 by making the tube 10 as the two-layer structure. Therefore, a particular member for providing the protruded tabs 15A and 15B is not necessary. Note that, in addition to the protruded tabs 15A and 15B, the protruded tabs 15 may be disposed on the inner layer 10 in of the tube 10.

Eighth Embodiment

Figure 17:
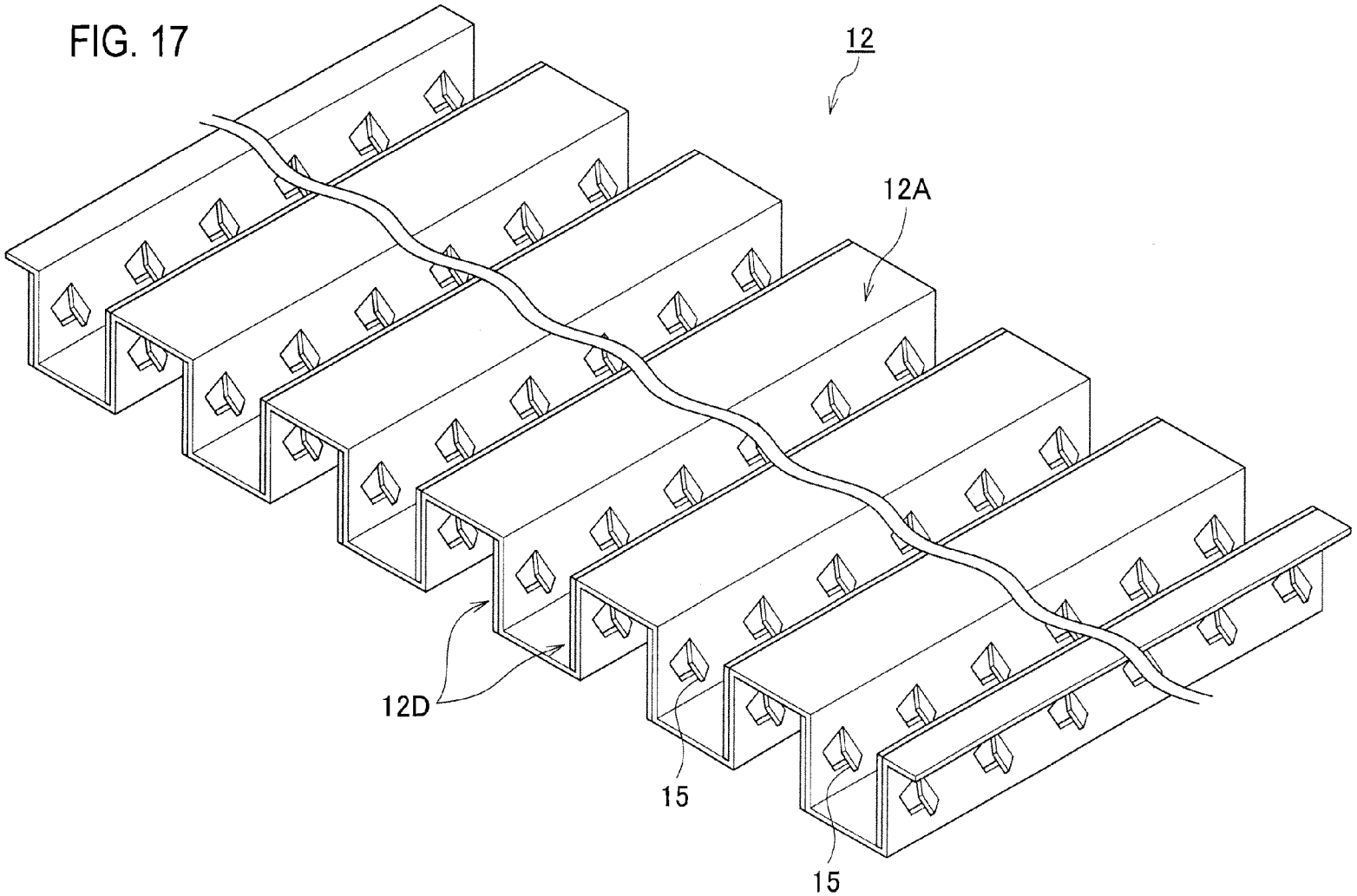
FIG. 17 It is a perspective view of a fin in an exhaust gas heat exchanger according to an eighth embodiment.
Figure 18:
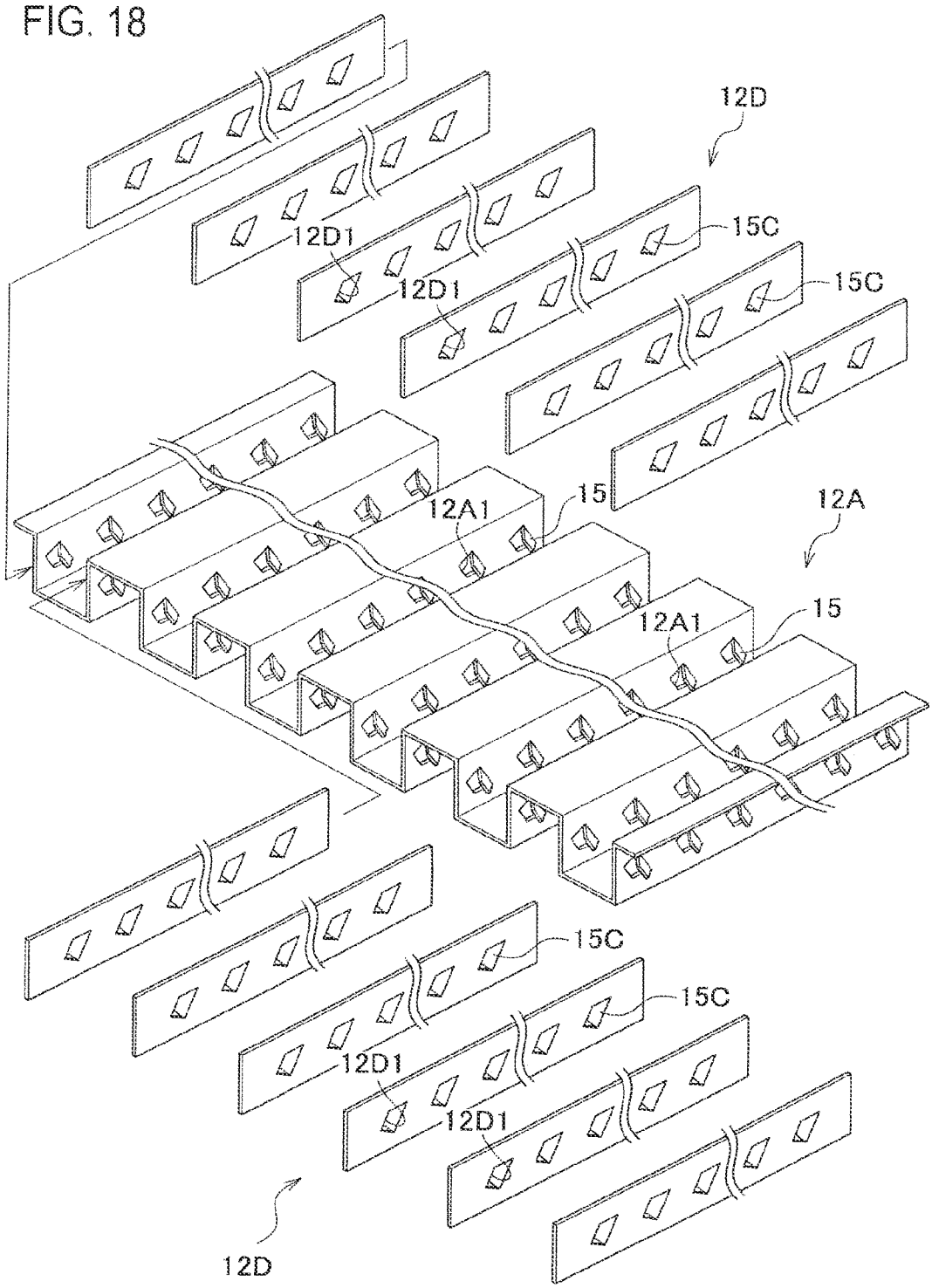
FIG. 18 It is an exploded perspective view of the fin.
Figure 19:
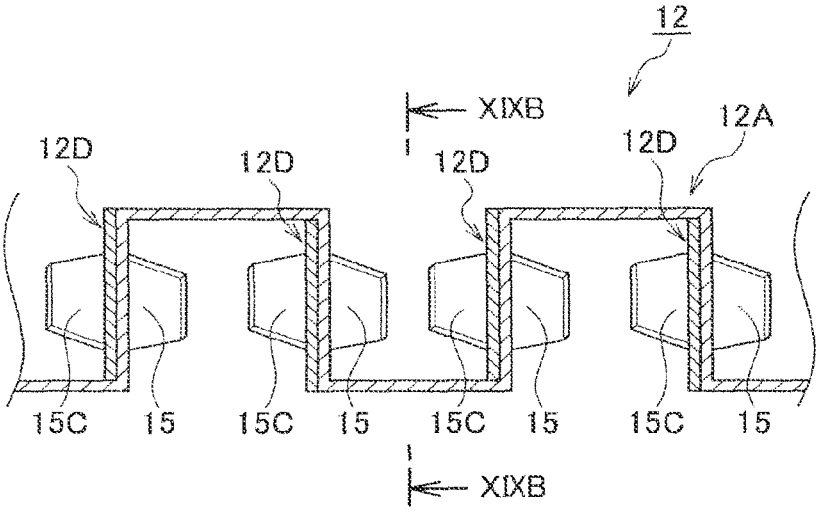
FIG. 19 (*a*) is a partially enlarged cross-sectional view of the fin, and (*b*) is a cross-sectional view taken along a line XIXB-XIXB in FIG. 19(*a*).
Figure 19:
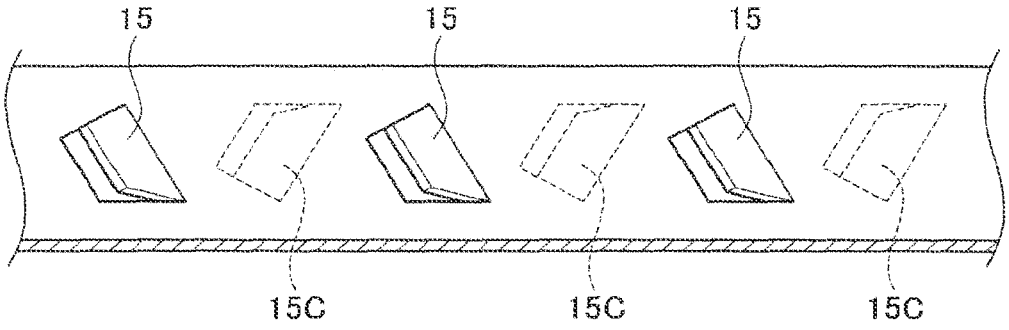
Figure 20:
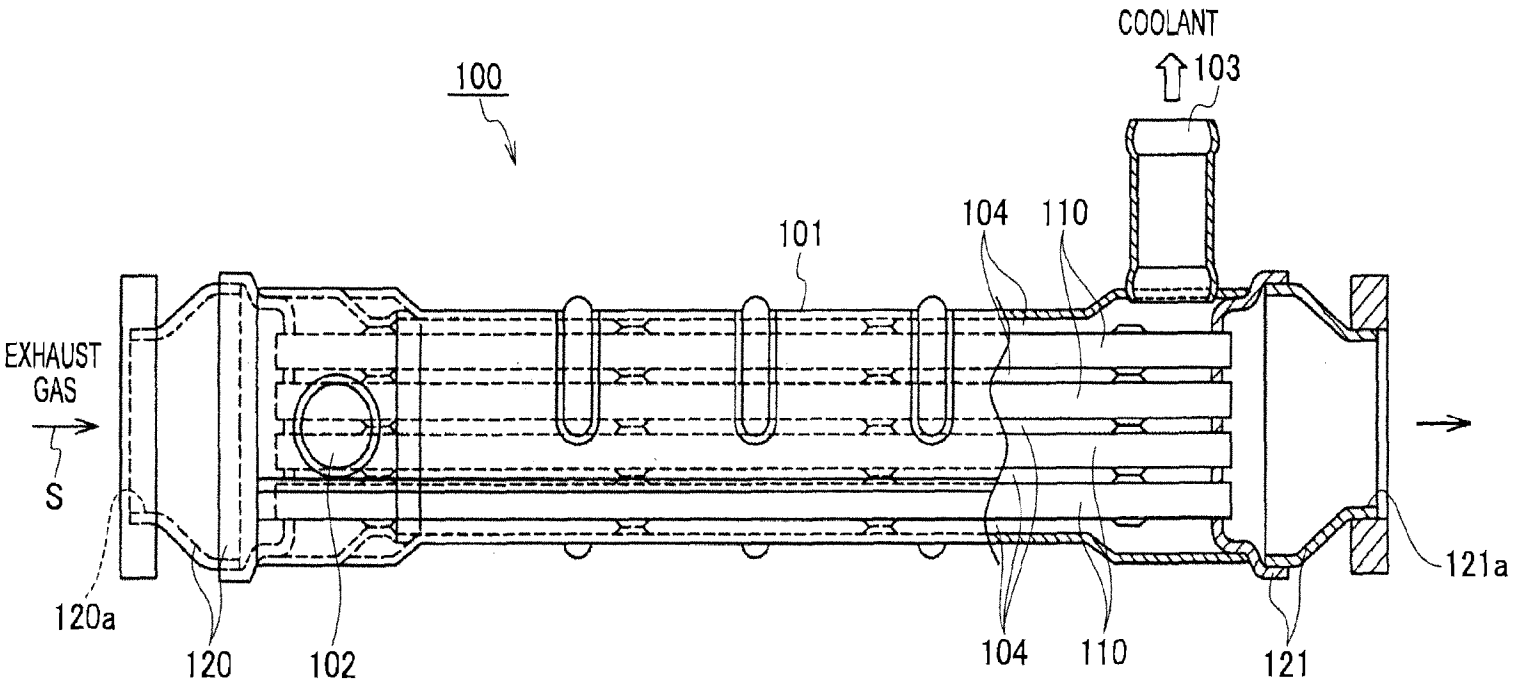
FIG. 20 It is a cross-sectional view of a prior-art exhaust gas heat exchanger.
Figure 21:
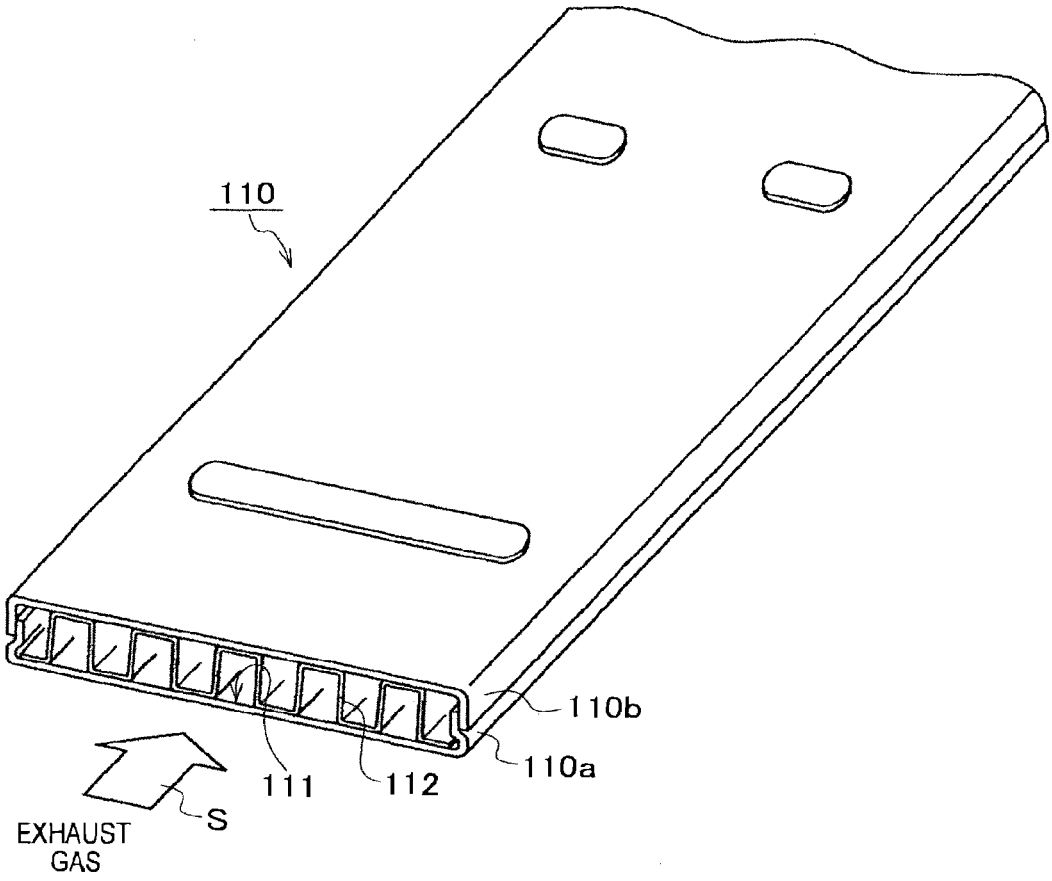
FIG. 21 It is a perspective view of a tube in the exhaust gas heat exchanger shown in FIG. 20.
Figure 22:
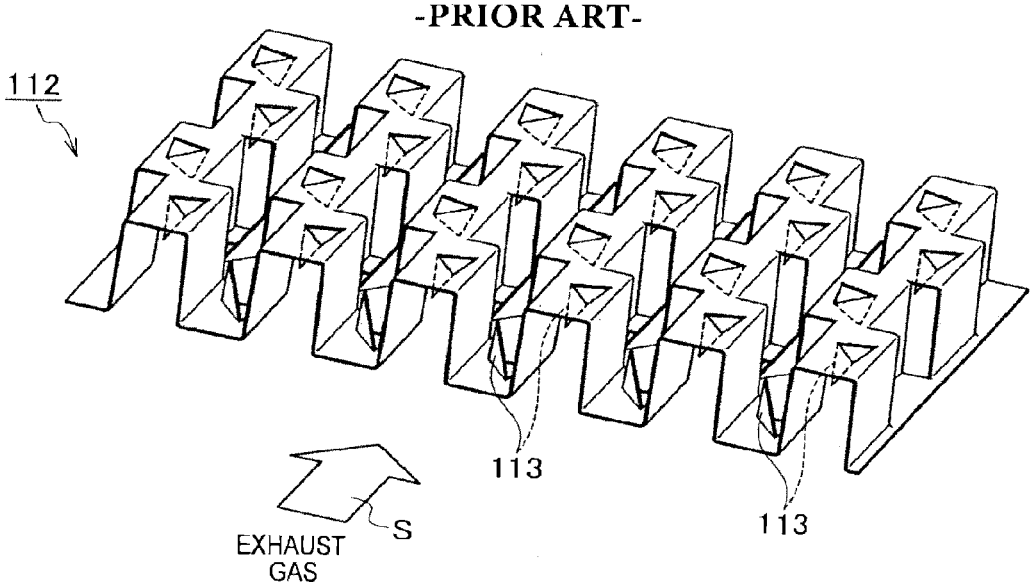
FIG. 22 It is a perspective view of a fin in the tube.
Figure 23:
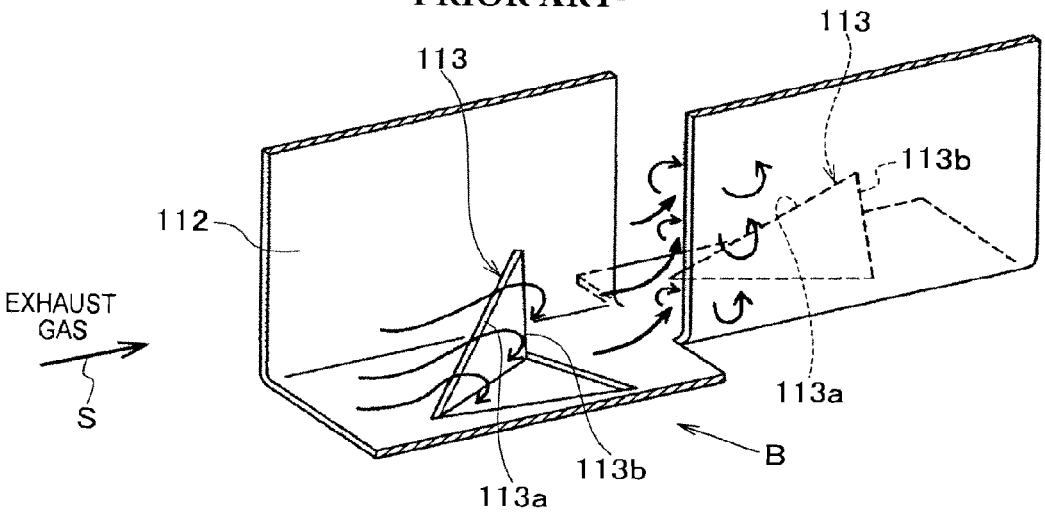
FIG. 23 It is a perspective view of a protruded tab(s) on the fin.
Figure 24:
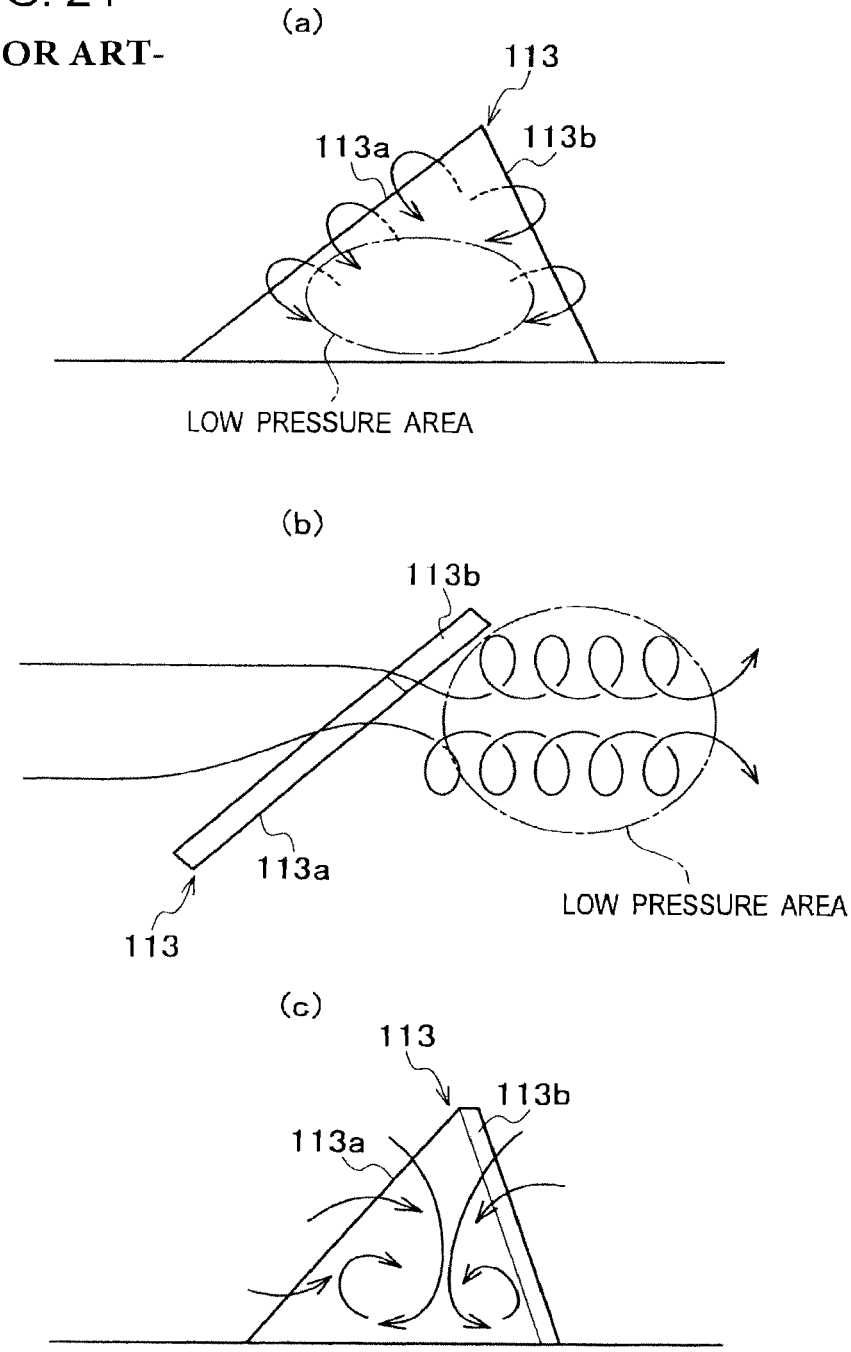
FIG. 24 (*a*) is a back view of the protruded tab viewed from a direction B in FIG. 23, (*b*) is a plan view of the protruded tab, and (*c*) is a back view showing swirl flows generated by the protruded tab and viewed from its downstream side.

An exhaust heat exchanger according to an eighth embodiment is shown in FIG. 17 to FIG. 19 (*b*). The protruded tabs 15 and 15C in the present embodiment are formed on two inner surfaces among plural inner surfaces (four surfaces) forming the segmented flow channel 11*a* similarly to the above-explained sixth and seventh embodiments. The fin 12 in the present embodiment is configured of a fin main member 12A that is a corrugated panel having a rectangular outline shape and in which horizontal walls 13 and vertical walls 14 are alternately-connected, and vertical plate members 12D adjacently contacted with the vertical walls 14.

Plural protruded tabs 15 are cut and raised at intervals along the exhaust gas flow direction S on the vertical walls 14 of the fin main member 12A (see FIG. 19(*a*)). Since other configurations of the protruded tab 15 are equivalent to configurations of the protruded tab 15 in the first embodiment, their redundant explanations are omitted.

The vertical plate member(s) 12D is planarly contacted and fixed with the vertical wall 14 by soldering, welding (e.g. spot welding), an engagement structure (e.g. an engagement pawl and an engagement hole) or the like. Also on the vertical plate member 12D, plural protruded tabs 15C are cut and raised at intervals along the exhaust gas flow direction S. As shown in FIG. 19(*b*), the protruded tabs 15D on each of the vertical plate member 12D and the protruded tabs 15 on the vertical wall 14 (the fin main member 12A) to which the vertical plate member 12D is attached are arranged alternately along the exhaust gas flow direction S, and the angular orientations of the protruded tabs 15C are made reversed to the angular orientations of the protruded tabs 15.

Note that, since the protruded tabs 15 are disposed along the exhaust gas flow direction S identically on the neighboring vertical walls 14, the protruded tabs 15C on each of the vertical plate member 12D and the protruded tabs 15 are arranged alternately along the exhaust gas flow direction S in the segmented flow channel 11*a* (the angular orientations of the protruded tabs 15C are made reversed to the angular orientations of the protruded tabs 15 in that segmented flow channel 11*a*). Since other configurations of the protruded tabs 15C are equivalent to configurations of the protruded tabs 15, 15A and 15B in the sixth and seventh embodiments, their redundant explanations are omitted.

According to the present embodiment, equivalent advantages achieved by the above-explained sixth and seventh embodiments are achieved. In addition, openings 12D1 (see FIG. 18) formed on the vertical plate member 12D by cutting and raising the protruded tabs 15C are closed by the vertical wall 14 of the fin main member 12A, and openings 12A1 (see FIG. 18) formed on the fin main member 12A by cutting and raising the protruded tabs 15 are closed by the vertical plate member 12D. Therefore, the swirl flows generated by the protruded tabs 15 and 15C don't pass through the openings 12A1 and 12D1, so that heat exchange efficiency can be improved further.

Note that the angular orientations of the protruded tabs 15C on the vertical plate member 12D may be made identical to the angular orientations of the protruded tabs 15 on the fin main member 12A. In addition, it is not necessary that the protruded tabs 15C and the protruded tab 15 may not be disposed alternately along the exhaust gas flow direction S, and the protruded tabs 15C and the protruded tab 15 may be disposed at identical locations along the exhaust gas flow direction S as long as the openings 12A1 and 12D1 are closed.

The present invention is not limited to the above-explained embodiments. For example, the protruded tab(s) 15 in the above-explained embodiments has a perpendicular trapezoidal shape with the angle a of the one lateral side 17=60° and the angle b of the other lateral side 18=90°. However, the protruded tab 15 may have a trapezoidal shape other than the above-explained trapezoidal shape, a quadrilateral shape other than a trapezoidal shape, or a polygonal shape more than a quadrilateral shape. Namely, it is sufficient that the protruded tab 15 has a polygonal shape more than a triangle shape having at least the bottom side 16 and the lateral sides 17 and 18, and that the angle a of the one lateral side to the bottom side 16 is set smaller than the angle b of the other lateral side 18 to the bottom side 16 and set smaller than 90 degrees. In other words, the angle b of the other lateral side 18 may be set to an angle smaller than 90 degrees or larger than 90 degrees as long as it is set larger than the angle a.

Further, it is preferable that the angle a of the one lateral side 17 has a large difference from the angle b of the other lateral side 18. Namely, when the protruded tab(s) 15 is formed with such a large difference, a flow amount of the first flow D1 on a side of the above-explained one lateral side 17 becomes larger than a flow amount of the second flow D2 on a side of the other lateral side 18. In addition, a flow amount of the first flow D1 at an upper portion of the inclination of the one lateral side 17 becomes larger than a flow amount of the first flow D1 at a lower portion of the inclination of the one lateral side 17. The first flow D1 is drawn strongly into the low pressure area due to this flow amount distribution, and thereby a single large stronger swirl flow can be generated.

Furthermore, the lateral side 17 or 18, or the top side 19 is not only straight, but also curved. Note that, when the one lateral side 17 is composed of plural straight lines (e.g. an end-side portion and a bottom-side portion), the angle a of the one lateral side 17 to the bottom side 16 means an angle of the end-side portion to the bottom side 16. Here, a portion of the one lateral side 17 close to the bottom side 16 is the bottom-side portion, and a portion of the one lateral side 17 far from the bottom side 16 is the end-side portion. This is because the end-side portion affects the above-explained first flow D1 more significantly than the bottom-side portion. Also when the one lateral side 17 is composed of a curved line, the angle a of the one lateral side 17 to the bottom side 16 means an angle of the end-side portion to the bottom side 16.

In the above-explained embodiments, each of the segmented flow channel 11*a* has four inner surfaces composed of one inner surface of the tube 10 and three inner surfaces of the fin 12, and has a rectangular cross-sectional shape. However, each cross-sectional shape of the segmented flow channel 11*a* may have a shape other than a rectangular shape (a polygonal shape such as a triangle shape, or a shape having a curved wall). In addition, the protruded tab(s) 15 is formed by cutting and raising, but may be formed by other methods (welding or the like). Note that holes formed on the horizontal walls 13 by cutting and raising the protruded tabs 15 are not shown in FIG. 4, FIG. 6, FIGS. 11(*a*) and (*b*), and FIGS. 12(*a*) and (*b*).

In addition, in the above-explained embodiments, the exhaust gas heat exchanger is applied to the EGR cooler 1. However, the exhaust gas heat exchanger may be applied to all that exchange heat between exhaust gas and cooling fluid in an internal combustion engine. For example, the exhaust gas heat exchanger can be applied to an exhaust heat recovery equipment in an air conditioner.

The invention claimed is:

1. An exhaust gas heat exchanger for exchanging heat between exhaust gas and cooling fluid of an internal combustion engine, comprising:

a tube forming an exhaust gas flow path through which the exhaust gas flows;

a fin disposed in the exhaust gas flow path; and a plurality of protruded tabs protruded from at least one of the tube and the fin to inhibit an exhaust gas flow, wherein each of the plurality of protruded tabs has a polygonal shape with at least four sides having at least a bottom side, one lateral side and another lateral side, and an angle of the one lateral side to the bottom side is set smaller than an angle of the other lateral side to the bottom side and set smaller than 90 degrees, each of the plurality of protruded tabs is inclined to an upstream side along an exhaust gas flow direction, and, in each of the plurality of protruded tabs, the bottom side is placed to intersect with a perpendicular direction to the exhaust gas flow direction, and the other lateral side is located upstream from the one lateral side.

2. The exhaust gas heat exchanger according to claim 1, wherein each of the plurality of protruded tabs has a trapezoidal shape in which the angle of the other lateral side to the bottom side is set to 90 degree and the angle of the one lateral side to the bottom side is set to 60 degrees.

3. The exhaust gas heat exchanger according to claim 1, wherein an inclined angle to an upstream side of each of the plurality of protruded tabs is set in a range not smaller than 40 degrees and not larger than 90 degrees.

4. The exhaust gas heat exchanger according to claim 3, wherein the inclined angle is set to 60 degrees.

5. The exhaust gas heat exchanger according to claim 1, wherein a placement angle of each of the plurality of protruded tabs is set in a range not smaller than 10 degrees and not larger than 50 degrees, the placement angle being an intersecting angle of the bottom side with the perpendicular direction.

6. The exhaust gas heat exchanger according to claim 5, wherein the placement angle is set to 30 degrees.

7. The exhaust gas heat exchanger according to claim 1, wherein each of the plurality of protruded tabs has a trapezoidal shape, and, when a length of the bottom side of each of the plurality of protruded tabs viewed in the exhaust gas flow direction is denoted as H and a height thereof is denoted as h, h/H is set in a range not smaller than 0.2 and not larger than 0.7.

8. The exhaust gas heat exchanger according to claim 1, wherein the exhaust gas flow path is segmented into a plurality of segmented flow channels aligned along the perpendicular direction to the exhaust gas flow direction, and, the plurality of protruded tabs is disposed at intervals along the exhaust gas flow direction in each of the plurality of segmented flow channels.

9. The exhaust gas heat exchanger according to claim 8, wherein every two of the plurality of protruded tabs adjacent side by side are aligned at intervals along the exhaust gas flow direction, and the two protruded tabs adjacent side by side has line-symmetrical shapes to each other with respect to the exhaust gas flow direction.

10. The exhaust gas heat exchanger according to claim 8, wherein the plurality of protruded tabs is aligned alternately on both sides of a center of a segmented flow channel along the exhaust gas flow direction in the plurality of segmented flow channels.

11. The exhaust gas heat exchanger according to claim 10, wherein the plurality of protruded tabs is overlapped at the center of the segmented flow channel along the exhaust gas flow direction.

12. The exhaust gas heat exchanger according to claim 8, wherein the plurality of protruded tabs is formed on at least two inner surfaces of each of the plurality of segmented flow channels.

13. The exhaust gas heat exchanger according to claim 12, wherein the at least two inner surfaces face to each other.

14. The exhaust gas heat exchanger according to claim 13, wherein the at least two inner surfaces are included in the fin, and back surfaces of the at least two inner surfaces are planarly contacted with inner surfaces of the tube.

15. The exhaust gas heat exchanger according to claim 12, wherein the protruded tabs formed on one of the at least two inner surfaces and the protruded tabs formed on another of the at least two inner surfaces are disposed alternately along the exhaust gas flow direction in each of the segmented flow channels.

* * * * *